United States Patent [19]

Hasegawa et al.

[11] Patent Number: 4,959,631

[45] Date of Patent: Sep. 25, 1990

[54] PLANAR INDUCTOR

[75] Inventors: Michio Hasegawa; Masashi Sahashi, both of Yokohama, Japan

[73] Assignee: Kabushiki Kaisha Toshiba, Kawasaki, Japan

[21] Appl. No.: 250,401

[22] Filed: Sep. 28, 1988

[30] Foreign Application Priority Data

| | | | |
|---|---|---|---|
| Sep. 29, 1987 | [JP] | Japan | 62-245472 |
| Sep. 29, 1987 | [JP] | Japan | 62-245473 |
| Mar. 16, 1988 | [JP] | Japan | 63-62261 |
| Mar. 16, 1988 | [JP] | Japan | 63-62262 |
| Jun. 9, 1988 | [JP] | Japan | 63-142043 |
| Jun. 20, 1988 | [JP] | Japan | 63-151779 |

[51] Int. Cl.[5] ..... H01F 15/02; H01F 27/30

[52] U.S. Cl. ..... 336/83; 336/180; 336/200; 336/232; 336/234

[58] Field of Search ..... 336/200, 232, 233, 234, 336/83, 206, 180, 181, 212

[56] References Cited

U.S. PATENT DOCUMENTS

| | | | |
|---|---|---|---|
| 3,833,872 | 9/1974 | Marcus et al. | 336/232 X |
| 4,021,705 | 5/1977 | Lichtblau | 361/402 |
| 4,494,100 | 1/1985 | Stengel et al. | 336/200 |
| 4,613,843 | 9/1986 | Esper et al. | 336/200 X |

FOREIGN PATENT DOCUMENTS 0096516 12/1983 European Pat. Off. .

58-14512 1/1983 Japan .

OTHER PUBLICATIONS

IEEE Transactions on Magnetics Mag 15, No. 6, Nov. (1979) 1803 Magnetic Think Film Inductors for Integrated Circuit Applications by R. F. Soohoo.

IEEE Transactions on Magnetics Mag 20, No. 5, Sep. (1984), 1804 Planer Inductor by K. Shirae et al.

*Primary Examiner*—Thomas J. Kozma

*Attorney, Agent, or Firm*—Oblon, Spivak, McClelland, Maier & Neustadt

[57] ABSTRACT

Disclosed is a planar inductor which has spiral conductor coil means sandwiched between ferromagnetic layers with insulating layers interposed therebetween. The spiral conductor coil means is formed of two spiral conductor coils of the same shape arranged flush with and close to each other. Moreover, the two spiral conductor coils are connected electrically to each other so that currents of different directions flow individually through the conductor coils. Furthermore, the spiral conductor coil means is sandwiched between the two ferromagnetic layers with the insulating layers therebetween, each of the ferromagnetic layers having an area greater than the combined area of the two conductor coils. In the planar inductor according to the present invention, inductance is prevented from lowering while its components are being bonded together, so that the inductance value per unit volume is increased.

4 Claims, 23 Drawing Sheets

PLANAR INDUCTOR

BACKGROUND OF THE INVENTION

1. Field of the Invention

The present invention relates to a planar inductor.

2. Description of the Related Art

Conventionally known are planar inductors in which two spiral conductor coils 1*a* and 1*b* are sandwiched between ferromagnetic ribbons 2*a* and 2*b* with insulating layers 3*a*, 3*b* and 3*c* alternately interposed between them, as shown in FIG. 1. FIG. 1A is a plane view of one such prior art planar inductor, and FIG. 1B is a sectional view of the inductor as taken along line A—A of FIG. 1A. Full and broken lines in the plane view of FIG. 1A, which are indicative of conductor coils 1*a* and 1*b*, respectively, correspond to the respective center lines of coils 1*a* and 1*b* shown in the sectional view of FIG. 1B. Insulating layers 3*a*, 3*b* and 3*c* are formed of a dielectric or the like. Coils 1*a* and 1*b* are connected electrically to each other via through hole 4, and form an inductor between terminals 5*a* and 5*b* at their respective end portions.

If a current is applied to spiral conductor coils 1*a* and 1*b* of the planar inductor, however, magnetic fluxes 6*a* and 6*b* flow in opposite directions from the center or through-hole 4, as shown in FIG. 2. As a result, gap portions 7*a* and 7*b*, where magnetic flux density is very low, exist at two positions near the central and outer peripheral portions of each conductor coil. Accordingly, the inductance is inevitably reduced. In this case, an intensive magnetic field is generated at central gap portion 73 by conductor coils 1*a* and 1*b*, while there is hardly any magnetic field at peripheral gap portion 7*b*. Thus, the reduction of the inductance is much greater at the peripheral portion than at the central portion.

Spiral conductor coils 1*a* and 1*b*, insulating layers 3*a*, 3*b* and 3*c*, and ferromagnetic ribbons 2*a* and 2*b*, which constitute the planar inductor, must be bonded together. If insulating layers 3*a*, 3*b* and 3*c* are formed from an organic polymer, for example, the individual layers may be bonded by being pressurized at a temperature not lower than the softening point of the material, or otherwise, the contact portions between the elements may be bonded by means of a suitable bonding agent.

If magnetostriction of ferromagnetic ribbons 2*a* and 2*b* is substantial, however, compressive stress or other stress acts on the surfaces of the ribbons while adjacent insulating layers 3*a*, 3*b* and 3*c* are being bonded. Interactions of the stress and the magnetostriction deteriorates the magnetic characteristics, thereby lowering the effective permeability. If ferromagnetic ribbons 2*a* and 2*b* are subject to strain during use of the completed planar inductor, the effective permeability also changes, so that the inductance may possibly vary. The higher the permeability, the more noticeable these phenomena will be.

In a magnetic circuit cf this planar inductor, if ferromagnetic ribbons 2*a* and 2*b* are thicker, then the magnetic resistance is generally reduced in proportion, thus increasing the inductance. However, this is inconsistent with the object to minimize the general thickness of the plane inductor.

Meanwhile, the planar inductor may be applied to an output-side choke coil of a DC-DC converter or the like. In this case, a high-frequency current superposed with a DC current flows through the planar inductor.

Therefore, the inductor requires a good DC superposition characteristic.

The conventional planar inductors have not, however, a very good DC superposition characteristic. If this characteristic of the inductor is poor, the inductance lowers, so that the control becomes difficult. Accordingly, the efficiency of the DC-DC converter lowers. Thus, it is not appropriate to apply the plane inductor directly to the DC-DC converter and the like.

SUMMARY OF THE INVENTION

An object of the present invention is to provide a planar inductor in which inductance is prevented from lowering as its components are bonded together, so that the inductance value per unit volume is increased.

Another object of the invention is to provide a planar inductor enjoying a small thickness and a higher inductor value per unit volume.

Still another object of the invention is to provide a planar inductor having a good DC superposition characteristic.

According to an aspect of the present invention, there is provided a planar inductor which has spiral conductor coil means sandwiched between ferromagnetic layers with insulating layers interposed therebetween, and is characterized in that the spiral conductor coil means is formed of two spiral conductor coils of the same shape arranged flush with and close to each other, the two spiral conductor coils are connected electrically to each other so that currents of different directions flow through the conductor coils, and the spiral conductor coil means is sandwiched between the two ferromagnetic layers with the insulating layers therebetween, each of the ferromagnetic layers having an area greater than the combined area of the two conductor coils.

Preferably, the absolute value of magnetostriction of each ferromagnetic layer is $1\times10^{-6}$ or less.

Preferably, moreover, the ferromagnetic layers are formed of an amorphous magnetic alloy.

Preferably, furthermore, the average thickness of each ferromagnetic layer ranges from 4 to 20 $\mu$m.

Also, the ferromagnetic layers should preferably be formed of a ribbon- or film-shaped high-permeability amorphous alloy which has recently started to attract public attention. In particular, the ferromagnetic layers should have a composition given by $$(Co_{1-a-x}Fe_aM_x)_{100-y}(Si_{1-b}B_b)_y,$$

where M is at least one of elements selected from the group including Ti, V, Cr, Cu, Zr, Ni, Nb, Mo, Hf, Ta, W, and platinum metals, and a, b, , and y are values within ranges given by $0.01\leqq a\leqq0.10$, $0.3\leqq b\leqq0.7$, $0\leqq x\leqq0.08$, and $15\leqq y\leqq35$, respectively.

In the above structural formula, Fe is an element for adjusting the magnetostriction to 0, and M is an element used to improve the thermal stability of the permeability. Since the thermal stability can be improved by setting value b within the range from 0.3 to 0.7, x may be 0. Value x is restricted within the range $0\leqq x\leqq0.08$ because the Curie temperature is too low to be practical if x exceeds 0.08. Si and B are elements essential to noncrystallization. Value y is restricted within the range $15\leqq y\leqq35$ because the thermal stability is too poor if y is less than 15, and because the Curie temperature is too low to be practical if y exceeds 35. Mixture ratio b between Si and B is restricted within $0.3 \leqq b \leqq 0.7$ because the thermal stability of the magnetic characteristic is particularly good in that case.

According to the planar inductor constructed in this manner, the path of magnetic flux is allowed to exit only in a gap portion in the center of the spiral conductor coil means, so that the inductance per unit volume can be increased, and the inductance of the whole planar inductor can be prevented from lowering.

By adjusting the absolute value of magnetostriction of each ferromagnetic layer to $1 \times 10^{-6}$ or less, moreover, the inductance can be prevented from lowering due to stress or the like which may be produced when the components of the planar inductor are bonded together.

By restricting the average thickness of each ferromagnetic within the range from 4 to 20 μm, furthermore, the inductance value per unit volume (L/V) can be prevented from being reduced. If the thickness of the ferromagnetic layer is less than 4 μm, the layer cannot enjoy a sectional area large enough for the passage of all the magnetic flux which is produced as the currents flow through the spiral conductor coils. Thus, leakage flux increases, so that the inductance lowers considerably, and therefore, inductance value L/V per unit volume is reduced. If the thickness of the ferromagnetic exceeds 20 μm, on the other hand, the sectional area of the layer in a magnetic circuit becomes large enough to allow the passage of all the magnetic flux produced in the aforesaid manner. Thus, the magnetic resistance is reduced, so that the leakage flux lessens, and the inductance increases. Since the volume of the planar inductor also increases, however, value L/V is rather reduced.

According to the present invention, there is provided a planar inductor which has spiral conductor coil means sandwiched between ferromagnetic layers with insulating layers interposed therebetween, and is characterized in that a ferromagnetic substance is disposed flush with and/or in the central portion of the spiral conductor coil means, and in a region surrounding the outer periphery of the spiral conductor coil means, so that the ferromagnetic substance is at least partially in contact with the ferromagnetic layers.

Preferably, the ferromagnetic substance consists essentially of a compact of ferromagnet powder or a composite including ferromagnetic powder.

According to the planar inductor constructed in this manner, the magnetic resistance is reduced at the central and peripheral portions of the spiral conductor coil means, so that the inductance per unit volume can be increased, and the inductance of the whole planar inductor can be prevented from lowering.

According to still another aspect of the present invention, there is provided a planar inductor which has spiral conductor coil means sandwiched between ferromagnetic layers with insulating layers interposed therebetween, and is characterized in that a ferromagnetic substance is disposed flush with and/or in the central portion of the spiral conductor coil means, and in a region surrounding the outer periphery of the spiral conductor coil means.

According to the planar inductor constructed in this manner, the magnetic resistance is reduced at the central and peripheral portions of the spiral conductor coil means, so that the inductance per unit volume can be increased, and the inductance of the whole planar inductor can be prevented from lowering.

According to a further aspect of the present invention, there is provided a planar inductor which comprises a plurality of layers of spiral conductor coil means stacked with insulating layers therebetween, and is characterized in that the spiral conductor coil means are electrically connected in series with one another so that currents of the same direction flow through the conductor coil means, and a laminated structure including the spiral conductor coil means and the insulating layers is sandwiched between ferromagnetic layers with insulating layers interposed therebetween.

Each spiral conductor coil means of the planar inductor is generally composed of a two-layer spiral conductor coil assembly in which spiral coils on either side of each insulating layer are connected via a through hole. Unless there is a hindrance to the removal of terminals, the spiral conductor coil means may be composed of only one spiral coil.

Preferably, the average thickness of each ferromagnetic layer ranges from 4 to 20 μm. Moreover, the ratio (t/l) of the thickness (t) of the ferromagnetic layer to the side length (l) thereof is preferably $1 \times 10^{-3}$ or more.

In general, laminate planar inductors may be classified into two types. According to type I, a plurality of planar inductors, each having a construction such that spiral conductor coil means is sandwiched between ferromagnetic layers with insulating layers interposed between them, are stacked in layers. Type II is constructed so that a plurality of spiral conductor coil means are stacked with insulating layers between them, and the laminated structure is sandwiched between ferromagnetic layers with insulating layers interposed between them. In type I, two insulating layers and two ferromagnetic layers exist between each two adjacent conductor coil means. In type II, on the other hand, only the insulating layer exists between each two adjacent coil means.

As a result of an earnest investigation by the inventors hereof, it was found that the ferromagnetic layers, existing between the adjacent spiral conductor coil means, as in the case cf type I, are hardly conducive to the increase of the inductance of the laminate planar inductors. It was also indicated that substantially the same inductance value for type I can be obtained even though only the insulating layer exists between each two adjacent spiral conductor coil means, without being accompanied by the ferromagnetic layers, as in the case of type II. Therefore, the planar inductor according to the present invention (type II) is generally thinner than the planar inductor of type I, and has substantially same general inductance value as type I. Thus, the inductance value per unit volume is greater.

According to the planar inductor of this type, moreover, reduction of the inductance value per unit volume (L/V) can be prevented by restricting the average thickness of each ferromagnetic layer within the range from 4 to 20 μm. If the thickness of the ferromagnetic layer is less than 4 μm, the layer cannot enjoy a sectional area large enough for the passage of all the magnetic flux which is produced as the currents flow through the spiral conductor coils. Thus, leakage flux increases, so that the inductance lowers considerably, and inductance value L/V per unit volume is reduced. If the thickness of the ferromagnetic layer exceeds 20 μm, on the other hand, the sectional area of the layer in the magnetic circuit becomes large enough to allow the passage of all the magnetic flux produced in the aforesaid manner. Thus, the magnetic resistance is reduced, so that the leakage flux lessens, and the inductance increases. Since the volume of the planar inductor also increases, however, value L/V is rather reduced.

In this planar inductor, the ratio (t/l) of the thickness (t) of the ferromagnetic layer to the side length (l) thereof is preferably $1\times10^{-3}$ or more for the following reason.

Generally, when using the planar inductor according to the present invention on the output side of a DC-DC converter, a DC current is superposed, so that the planar inductor requires a good DC superposition characteristic. The superposed DC current is estimated at 0.2 A or more.

In this planar inductor, the magnetic flux is supposed to flow in the planar direction of the ferromagnetic layers. In this case, the coefficient of planar diamagnetic field of the ferromagnetic layers influences the planar magnetic resistance. More specifically, if the coefficient of diamagnetic field is greater, then the magnetic resistance increases in proportion. Thus, the increase of the magnetic resistance produces the same effect as a planar magnetic gap, thereby improving the DC superposition characteristic of the inductance. Preferably, a high-permeability amorphous alloy should be used for the ferromagnetic layers.

In a square planar inductor, for example, if the ratio of the thickness of each ferromagnetic layer to the side length thereof is greater, then the coefficient of planar diamagnetic field of the ferromagnetic layer increases in proportion. In other words, the greater the thickness of the ferromagnetic layer, or the shorter the side length, the greater the coefficient of diamagnetic field is. If the ratio between the thickness and the side length is $10^{-3}$ or more, the magnetic resistance increases, so that the DC superposition characteristic of the inductance is improved. If the spiral conductor coils or a laminated structure thereof and, therefore, the ferromagnetic layers on either side thereof are circular in shape, the magnetic resistance increases, thus improving the DC superposition characteristic of the inductance, when the ratio of the thickness of each ferromagnetic layer to the diameter thereof is $10^{-3}$ or more. In order to increase the thickness of the ferromagnetic layer, a laminated structure including a plurality of ferromagnetic ribbons may be used as the ferromagnetic layer, for example. The same effect may be also obtained with use of a planar inductor which has no laminate construction.

According to a still further aspect of the present invention, there is provided a planar inductor which comprises spiral conductor coil means or a laminated structure including a plurality of spiral conductor coil means sandwiched between ferromagnetic layers each including a plurality of ferromagnetic ribbons, each of the ferromagnetic ribbons having a thickness of 100 μm or less.

In the planar inductor constructed in this manner, the magnetic flux flows in the planar direction of the ferromagnetic layers. Therefore, if each ferromagnetic layer is formed of a plurality of ferromagnetic ribbons stacked in layers, as in this planar inductor, the general thickness of the ferromagnetic layer becomes greater, so that planar diamagnetic fields increase. Thus, the magnetic resistance can be enhanced, thereby improving the DC superposition characteristic of the inductance.

The spiral conductor coils may be stacked in layers. In this case, however, it is advisable to dispose only the insulating layers between the conductor coils, without interposing the ferromagnetic layers. This is because the existence of the ferromagnetic layers between the conductor coils is hardly conducive to the increase of the inductance, and instead, causes the general thickness of the planar inductor to increase, thereby lowering the inductance per unit volume.

In the planar inductor constructed in this manner, the thickness of each of the ferromagnetic ribbons constituting each ferromagnetic layer is adjusted to 100 μm less for the following reason. Generally, when applying the planar inductor to a DC-DC converter or the like which is used with a frequency of 10 kHz or more, if the ribbon thickness exceeds 100 μm, the magnetic flux is prevented from penetrating the ferromagnetic layer by a skin effect. Thus, the inductance cannot increase in proportion to the increase of the thickness of the ferromagnetic ribbon, so that the inductance per unit volume is rather reduced. Preferably, the thickness of each ferromagnetic ribbon should be 4 μm or more. If the ribbon thickness is less than 4 μm, the ribbon cannot enjoy a sectional area large enough for the passage of all the magnetic flux which is produced as the currents flow through the spiral conductor coils. Thus, leakage flux increases, so that the inductance lowers considerably, and therefore, the inductance value per unit volume is reduced.

In this planar inductor, moreover, a plurality of ferromagnetic ribbons are used to form each ferromagnetic layer because the DC superposition characteristic cannot be improved with use of only one ribbon for each ferromagnetic layer, as in the case of the prior art planar inductors. As the ferromagnetic ribbons used in each ferromagnetic layer are increased in number, the DC superposition characteristic is improved considerably. If the number exceeds ten, however, the effect of improvement is reduced. Thus, the volume increases for nothing, so that the inductance per unit volume lowers. Preferably, after all, two to ten ferromagnetic ribbons are used for the purpose.

For the improvement of the DC superposition characteristic, moreover, the ratio of the thickness (t) of each ferromagnetic layer, composed of a plurality of ferromagnetic ribbons to the side length, should range from $2\times10^{-3}$ to $1\times10^{-2}$.

In a square planar inductor, for example, if the ratio of the thickness of each ferromagnetic layer to the side length thereof is greater, then the coefficient of planar diamagnetic field of the ferromagnetic layer increases in proportion. In other words, the greater the thickness of the ferromagnetic layer, or the shorter the side length, the greater the coefficient of diamagnetic field is. If the ratio between the thickness and the side length ranges from $2\times10^{-3}$ to $1\times10^{-2}$, the magnetic resistance increases, so that the DC superposition characteristic of the inductance can be improved. If the spiral conductor coils or a laminated structure thereof and, therefore, the ferromagnetic layers on either side thereof are circular in shape, the magnetic resistance increases, thus improving the DC superposition characteristic of the inductance, when the ratio of the thickness of each ferromagnetic layer to the diameter thereof ranges from $2\times10^{-3}$ to $1\times10^{-2}$.

DETAILED DESCRIPTION OF THE PREFERRED EMBODIMENTS

Preferred embodiments of the present invention will now be described with reference to the accompanying drawings.

Figure 1A:
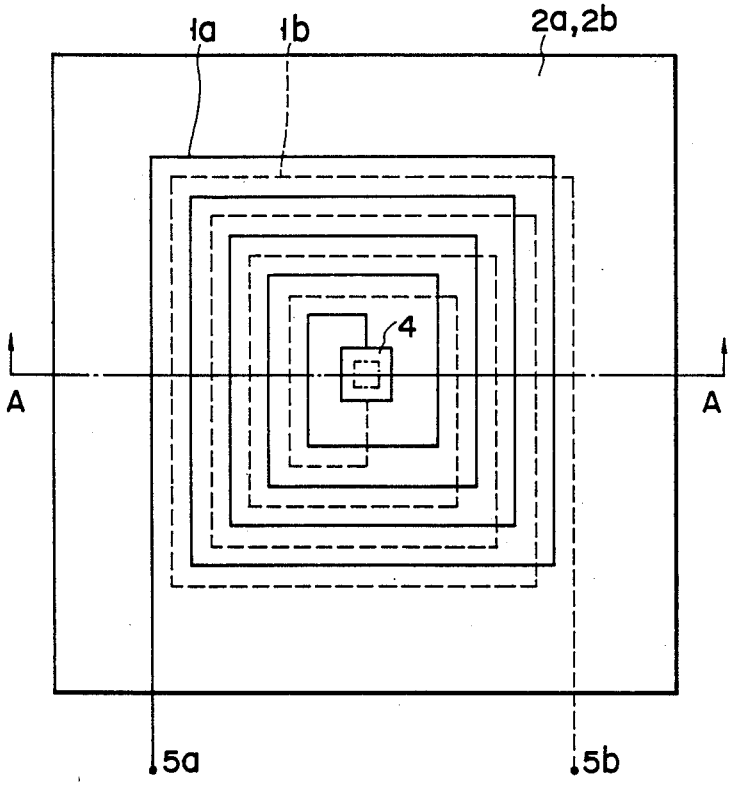
FIG. 1A (PRIOR ART)
FIG. 1A is a plane view of a prior art planar inductor.
Figure 1B:
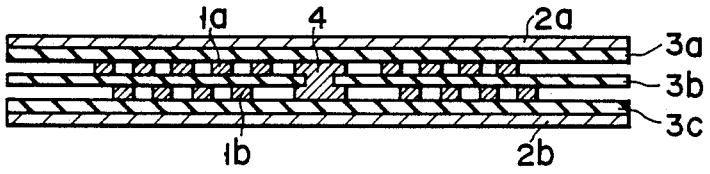
FIG. 1B (PRIOR ART)
FIG. 1B is a sectional view of the prior art planar inductor as taken along line A—A of FIG. 1A.
Figure 2:
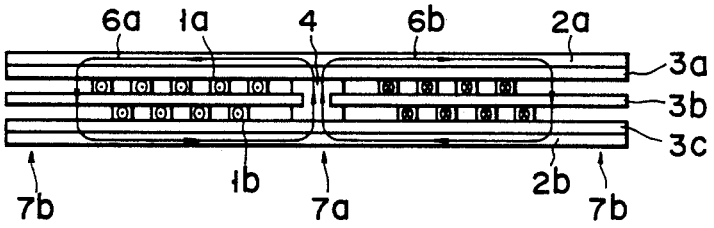
FIG. 2 (PRIOR ART)
FIG. 2 is a diagram for illustrating flux paths of the prior art planar inductor.
Figure 3A:
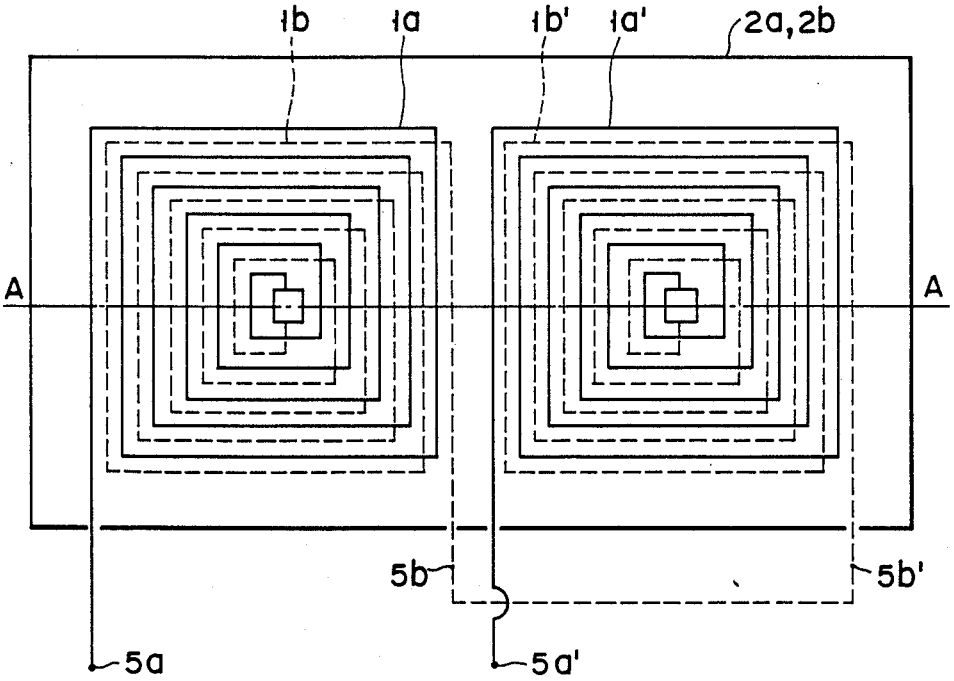
FIG. 3A is a plane view of a planar inductor according to a first embodiment of the present invention.
Figure 3B:
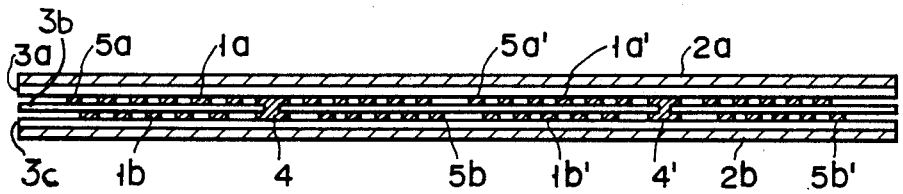
FIG. 3B is a sectional view of the planar inductor of the first embodiment as taken along line A—A of FIG. 3A.

FIG. 3A is a plane view of a planar inductor according to a first embodiment of tHe present invention, and FIG. 3B is a sectional view of the planar inductor as taken along line A—A of FIG. 3A. In these drawings, like reference numerals are used to designate the same portions as are included in the prior art planar inductor shown in FIG. 1. The planar inductor of this embodiment is constructed so that two pairs of spiral conductor coils 1*a*, 1*b*, 1*a'* and 1*b'* of the same shape, each arranged in two layers, are situated flush with and close to each other, with insulating layers 3*a*, 3*b* and 3*c* alternately interposed between the layers. Ferromagnetic ribbons 2*a* and 2*b*, which have an area wider than the area covered by the conductor coils, are pasted individually on the opposite sides of the coil assembly, with insulating layers 3*a* and 3*c* between them. Conductor coils 1*a*, 1*b*, 1*a'* and 1*b'* are connected electrically to one another so that currents of opposite directions flow through each two adjacent coils.

Spiral conductor coils 1a, 1b, 1a' and 1b' are each formed of a two-layer coil which, obtained by etching a copper foil of 20 μm thickness, for example, has a 1-mm width, 1-mm coil pitch, and 10 turns.

Insulating layers 3a, 3b and 3c are each formed of a polycarbonate sheet of 20 μm thickness, for example.

Ferromagnetic ribbons 2a and 2b are each composed of a sheet of 25 mm by 55 mm which is obtained by cutting down a Co-based amorphous alloy ribbon (with effective permeability of about $1.2\times10^4$ at kHz and zero or nearly zero magnetostriction) having a thickness of about 16 μm and a width of 25 mm. The alloy ribbon may, for example, be formed by single rolling.

The components, including spiral conductor coils 1a, 1b, 1a' and 1b', are assembled by being kept at a temperature of 170° C. and a pressure of 5 kg/cm$^2$ for about 10 minutes, for example.

Figure 4:
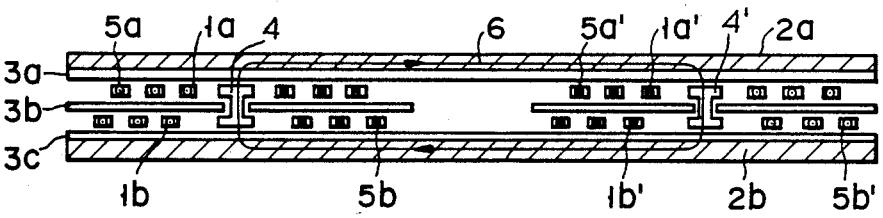
FIG. 4 is a diagram for illustrating a flux path of the planar inductor of the first embodiment.

The path of magnetic flux 6 of the planar inductor (Embodiment 1) constructed in this manner is indicated by an arrowhead line in FIG. 4. The frequency characteristic of this planar inductor was actually examined. Characteristic curve I of FIG. 5 represents the result of the examination.

For comparison, two planar inductors, each composed of the same spiral conductor coils, insulating layers, and ferromagnetic ribbons as are used in Embodiment 1, were simply connected electrically in series with each other (Comparative Example 1). The frequency characteristic of this comparative example was also examined. Curve II of FIG. 5 represents the examination result. In the inductors of Comparative Example 1, each ferromagnetic ribbon measures 25 mm by 25 mm.

Figure 5:
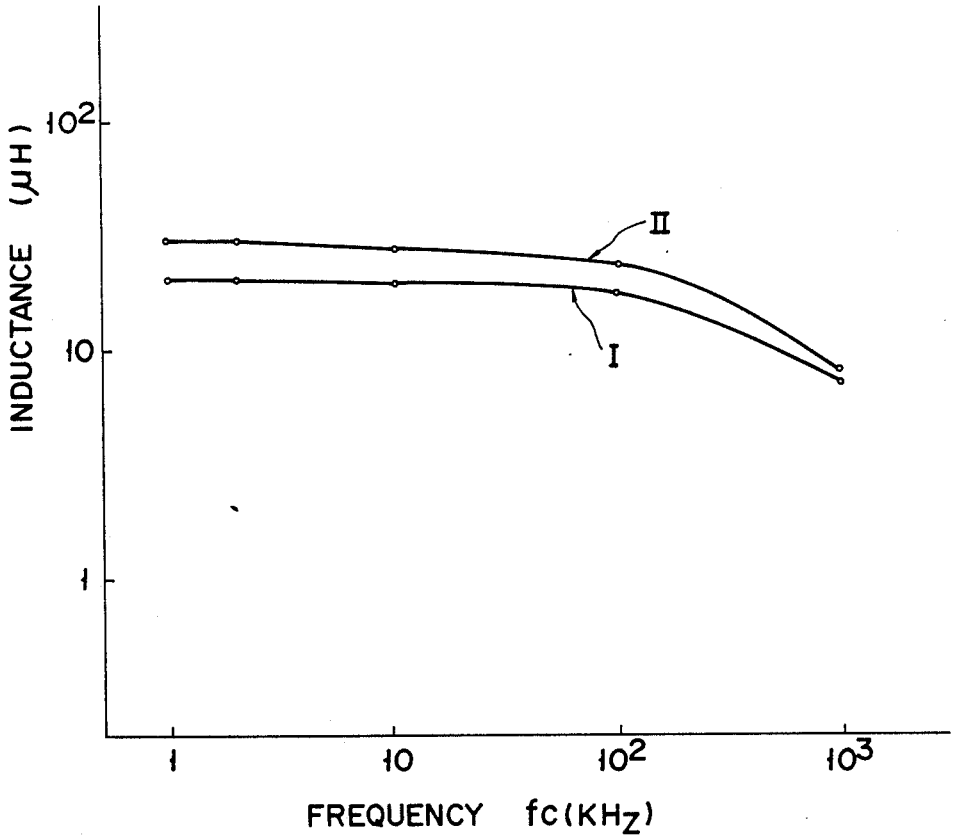
FIG. 5 shows characteristic curves indicative of relationships between the inductance and the frequency of the planar inductor.

As seen from the results shown in FIG. 5, the planar inductor of Embodiment 1, as compared with the two series-connected planar inductors of Comparative Example 1, was found to have a greater inductance value throughout the frequency band and, therefore, an improved inductance value per unit volume, thus enjoying very high efficiency.

Alternative planar inductors for comparison (Comparative Example 2) were prepared. These inductors have the same construction as those of Comparative Example 1, except that the ferromagnetic ribbons are formed of an Fe-based amorphous alloy with magnetostriction of about $8\times10^{-6}$. The inductance of the inductors of Comparative Example 2 was substantially halved when they are bent slightly. In contrast with this, the planar inductor of Embodiment 1 hardly exhibited any change although they were bent in the same manner. Thus, it was revealed that the inductance value of the planar inductor of Embodiment 1 is stable even though the inductor is subjected to a stress produced while the components are being bonded together or a bending moment during use.

Subsequently, the influence of the thickness of the ferromagnetic ribbons was examined on the planar inductor of Embodiment 1. In this case, spiral conductor coils 1a, 1b, 1a' and 1b', which are formed by etching a thick copper foil of 35 μm thickness, have a width of 0.25 mm, coil pitch of 0.25 mm, 40 turns, and external size of 20 mm by 20 mm. These coils are arranged in two layers so that insulating layer 3b, formed of a polyimide film of 25 μm thickness, is interposed between the layers, and are connected to one another through a through hole in the center. A polyimide film of 12 μm thickness is used for insulating layers 3a and 3c.

Ferromagnetic ribbons 2a and 2b, which have an external size of 25 mm by 55 mm each, are obtained by cutting down four Co-based amorphous alloy ribbons with different average thicknesses, ranging from 5 to 25 μm, the alloy ribbons being formed by simple rolling and having a composition as follows:

$$(Co_{0.88}Fe_{0.06}Ni_{0.04}Nb_{0.02})_{75}Si_{10}B_{15}.$$

The effective permeability of this Co-based amorphous alloy is $2\times10^4$ (1 kHz) or $1\times10^4$ (100 kHz).

Figure 6:
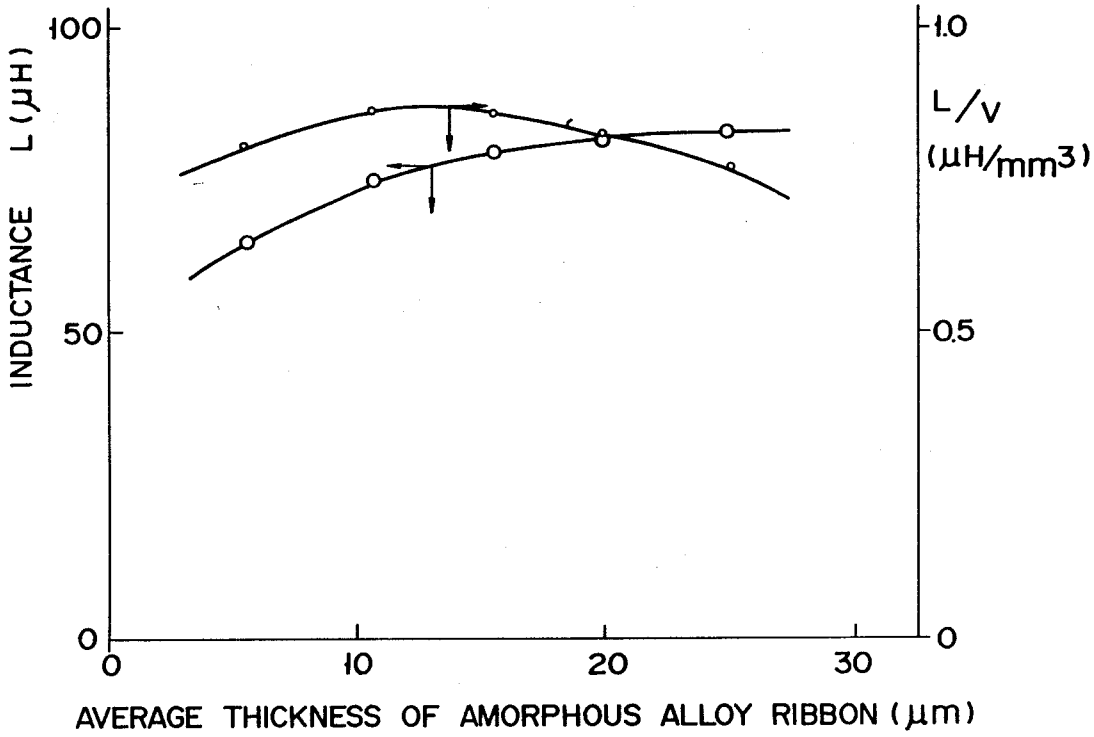
FIG. 6 shows characteristic curves indicative of a relationship between the inductance of the planar inductor of the first embodiment and the average thickness of a ferromagnetic ribbon and a relationship between the inductance per unit volume (L/V) and the average ribbon thickness.

FIG. 6 shows the dependence of the inductance (L) on the thickness of ferromagnetic ribbons 2a and 2b and the dependence of the inductance value per unit volume (L/V) on the ribbon thickness, with respect to the planar inductors described above.

As seen from FIG. 6, inductance L tends to increase as the average thickness of ferromagnetic ribbons 2a and 2b increases, while value L/V has a maximum when the average ribbon thickness ranges from about 10 to 15 μm. Thus, the ribbon thickness should range from 4 to 20 μm, preferably from 10 to 15 μm.

Figure 7A:
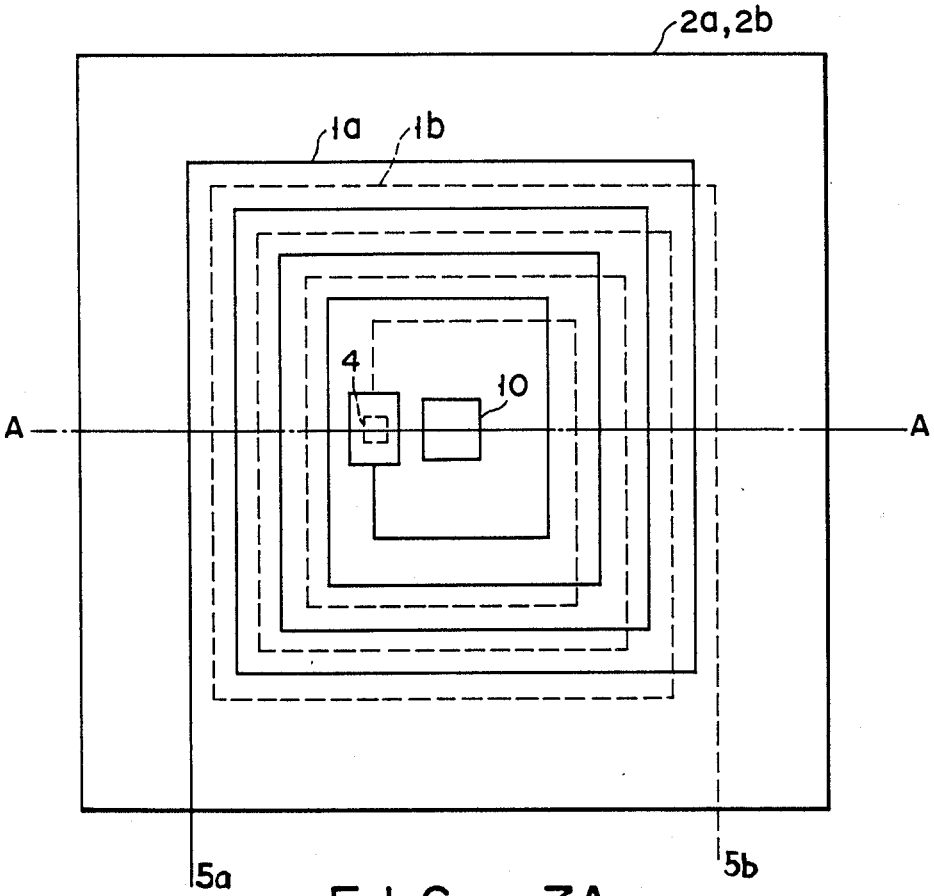
FIG. 7A is a plane view of a plan view of a planar inductor according to a second embodiment of the present invention.
Figure 7B:
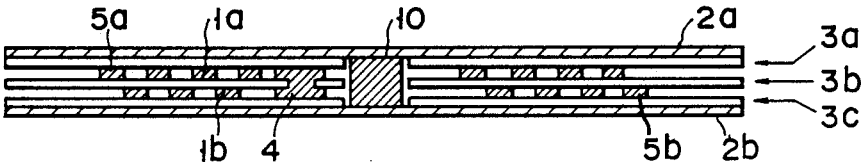
FIG. 7B is a sectional view of the planar inductor of the second embodiment as taken along line A—A of FIG. 7A.

A second embodiment of the present invention will now be described. FIG. 7A is a plane view of a planar inductor according to the second embodiment, and FIG. 7B is a sectional view of the inductor as taken along line A—A of FIG. 7A. The planar inductor of this embodiment is constructed so that two pairs of spiral conductor coils 1a and 1b of the same shape are arranged in two layers, with insulating layers 3a, 3b and 3c alternately interposed between the layers. Ferromagnetic ribbons 2a and 2b, which have an area wider than the area covered by the conductor coils, are pasted individually on the opposite sides of the coil assembly, with insulating layers 3a and 3c between them. Ferromagnetic substance 10 is disposed in the center of the coil assembly so as to be in contact with ferromagnetic ribbons 2a and 2b.

Spiral conductor coils 1a and 1b are each formed of a two-layer coil which, obtained by etching a copper foil of 20 μm thickness, for example, has a 1-mm width, 1-mm coil pitch, and 10 turns.

Insulating layers 3a, 3b and 3c are each formed of a polycarbonate sheet of 20μm thickness, for example.

Ferromagnetic ribbons 2a and 2b are each composed of a sheet of 25 mm by 25 mm which is obtained by cutting down a Co-based amorphous alloy ribbon (with effective permeability of about $1.2\times10^4$ at 1 kHz and zero or nearly zero magnetostriction) having a thickness of about 16 μm and a width of 25 mm. The alloy ribbon may, for example, be formed by single rolling.

Ferromagnetic substance 10 is composed of four or five pieces of 2 mm by 2 mm which are obtained by cutting down a Co-based amorphous alloy ribbon, for example.

The components, including spiral conductor coils 1a and 1b, are assembled by being kept at a temperature of 170° C. and a pressure of 5 kg/cm$^2$ for about 10 minutes, for example.

Figure 8:
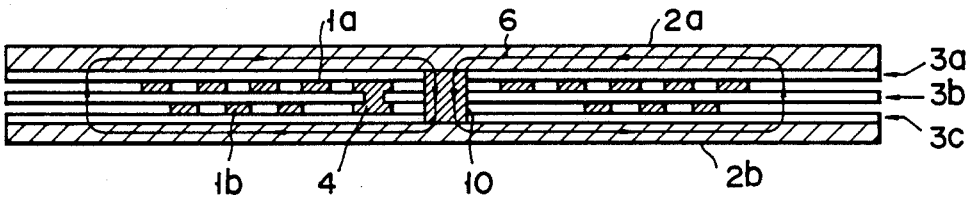
FIG. 8 is a diagram for illustrating flux paths of the planar inductor of the second embodiment.

The path of magnetic flux 6 of the planar inductor (Embodiment 2) constructed in this manner is indicated by an arrowhead line in FIG. 8. The frequency characteristic of this planar inductor was actually examined. Characteristic curve I of FIG. 9 represents the result of the examination.

For comparison, a planar inductor, composed of the same spiral conductor coils, insulating layers, and ferromagnetic ribbons as are used in Embodiment 2, was formed having a gap portion without a ferromagnetic substance in the center of the coil assembly (Comparative Example 3). The frequency characteristic of this comparative example was also examined. Curve II of FIG. 9 represents the examination result.

Figure 9:
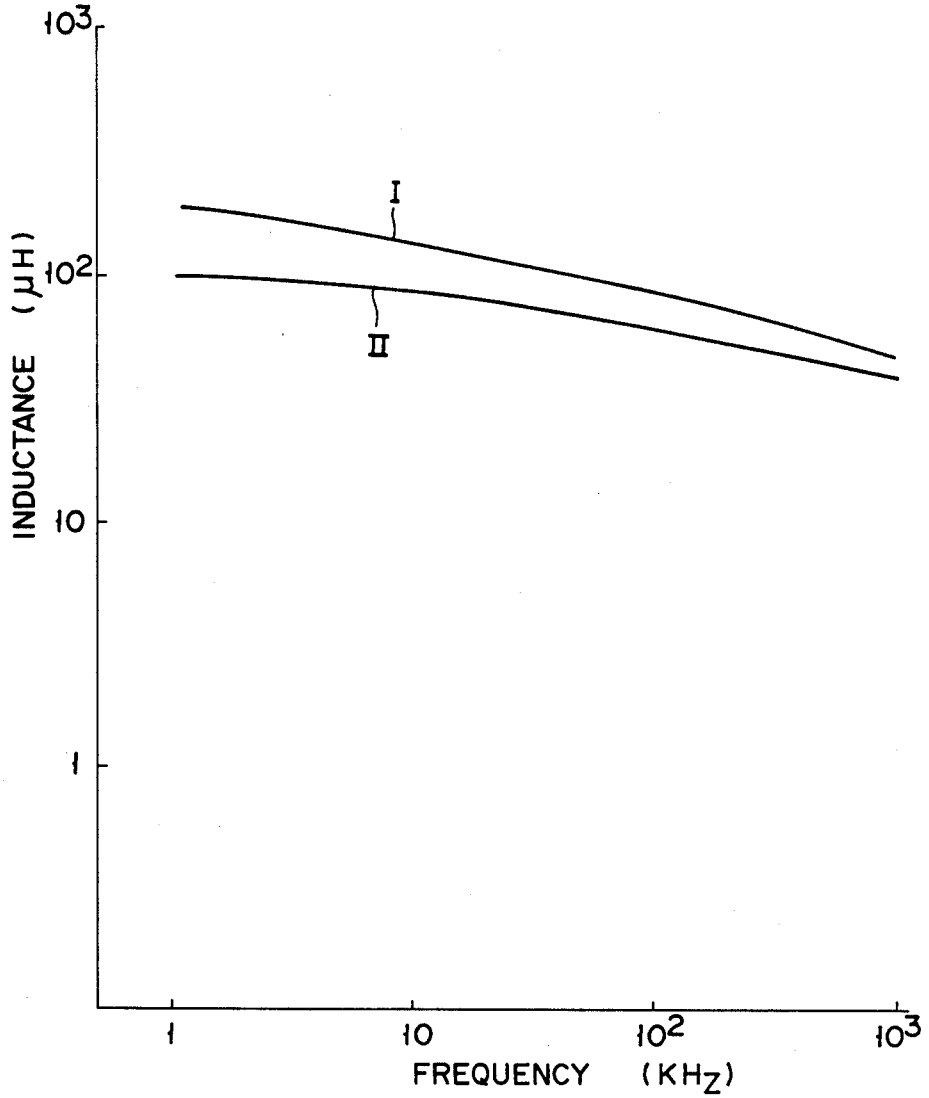
FIGS. 9, 11 and 14 show characteristic curves indicative of relationships between the inductance and frequency of the planar inductor of the second embodiment.

As seen from the results shown in FIG. 9, the planar inductor of Embodiment 2, in which the gap portion in the center of the coil assembly is short-circuited by means of ferromagnetic substance 10 set therein, was found to have a greater inductance value throughout the frequency band and, therefore, an improved inductance value per unit volume, as compared with Comparative Example 3, thus enjoying very high efficiency.

An alternative planar inductor for comparison (Comparative Example 4) was prepared. This inductor has the same construction as that of Comparative Example 3, except that the ferromagnetic ribbons are formed of an Fe-based amorphous alloy with magnetostriction of about $8\times10^{-6}$. The inductance of the inductor of Comparative Example 4 was substantially deteriorated when they are bent slightly. In contrast with this, the planar inductor of Embodiment 2 hardly exhibited any change although they were bent in the same manner. Thus, it was revealed that the inductance value of the planar inductor of Embodiment 2 is stable even though the inductor is subjected to a stress produced while the components are being bonded together or a bending moment during use.

Embodiment 3

Figure 10A:
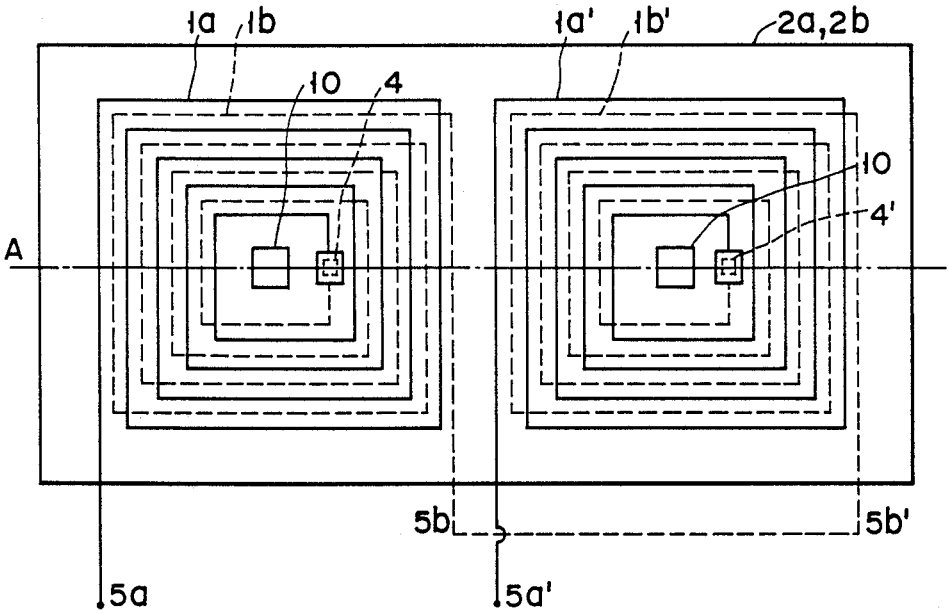
FIGS. 10A, 12A and 15A are plane views of planar inductors according to third, fourth, and fifth embodiments of the present invention, respectively.
Figure 10B:
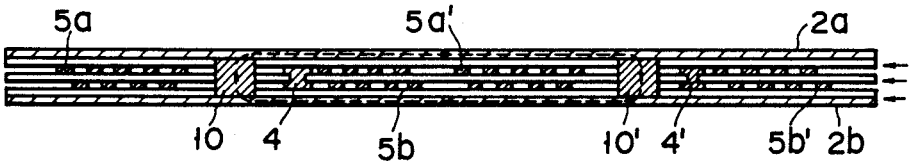
FIGS. 10B, 12B and 15B are sectional views of the planar inductors of the third, fourth, and fifth embodiments as taken along lines A—A of FIGS. 10A, 12A and 15A, respectively.

A planar inductor according to Embodiment 3 was manufactured, as shown in FIG. 10. In this embodiment, two planar inductors of Embodiment 2 are arranged so that two pairs of spiral conductor coils 1*a*, 1*b*, 1*a'* and 1*b'* are situated flush with and close to each other. Ferromagnetic ribbons 2*a* and 2*b*, which have an area wider than the area covered by the conductor coils, are pasted individually on the opposite sides of the coil assembly, with insulating layers 3*a* and 3*c* between them. Conductor coils 1*a*, 1*b*, 1*a'* and 1*b'* are connected electrically to one another so that currents of opposite directions flow through each two adjacent coils. The frequency characteristic of this planar inductor was actually examined. Characteristic curve I' of FIG. 11 represents the result of the examination.

For comparison, a planar inductor, composed of the same spiral conductor coils, insulating layers, and ferromagnetic ribbons as are used in Embodiment 3, was formed having a gap portion without a ferromagnetic substance in the center of the coil assembly (Comparative Example 5). The frequency characteristic of this comparative example was also examined. Curve II' of FIG. 11 represents the examination result.

Figure 11:
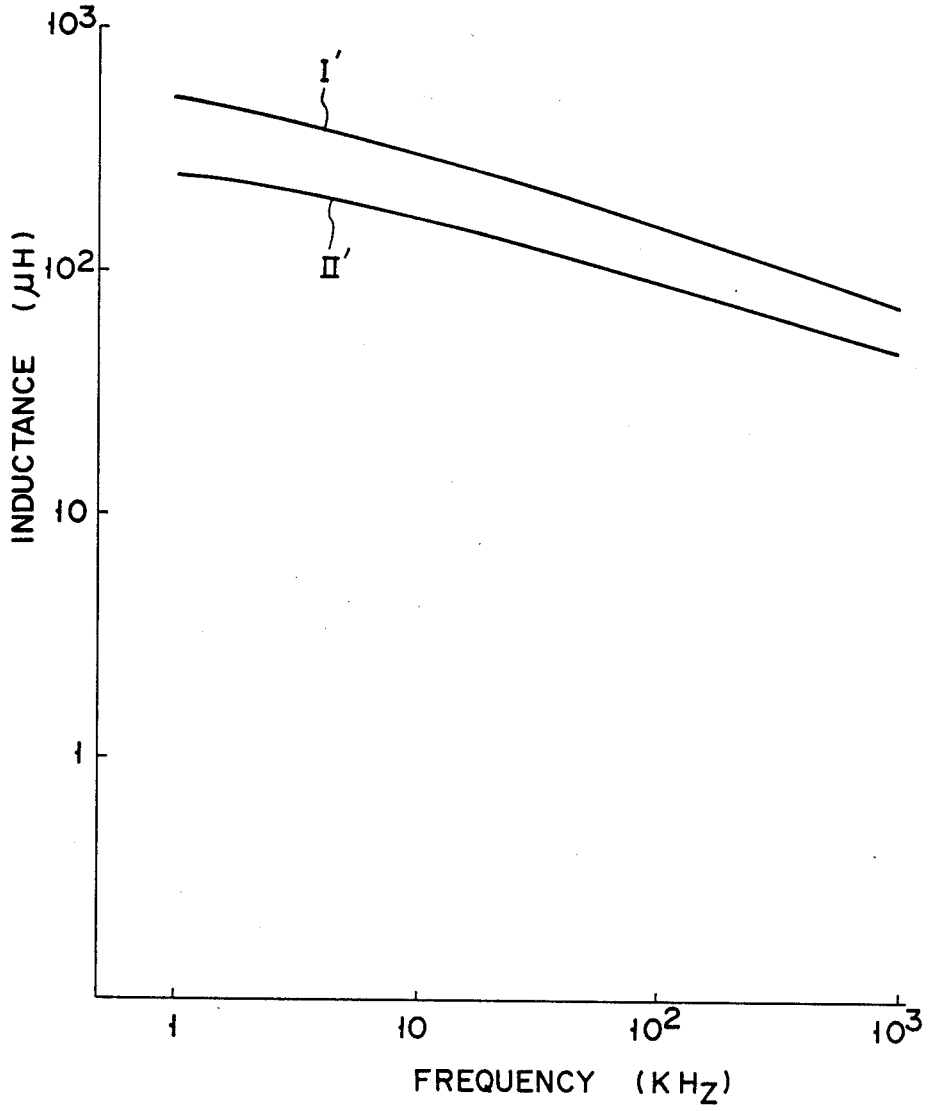

As seen from the results shown n FIG. 11, the planar inductor of Embodiment 3, as compared with Comparative Example 5, was found to have a greater inductance value throughout the frequency band and, therefore, an improved inductance value per unit volume.

Embodiment 4

Figure 12A:
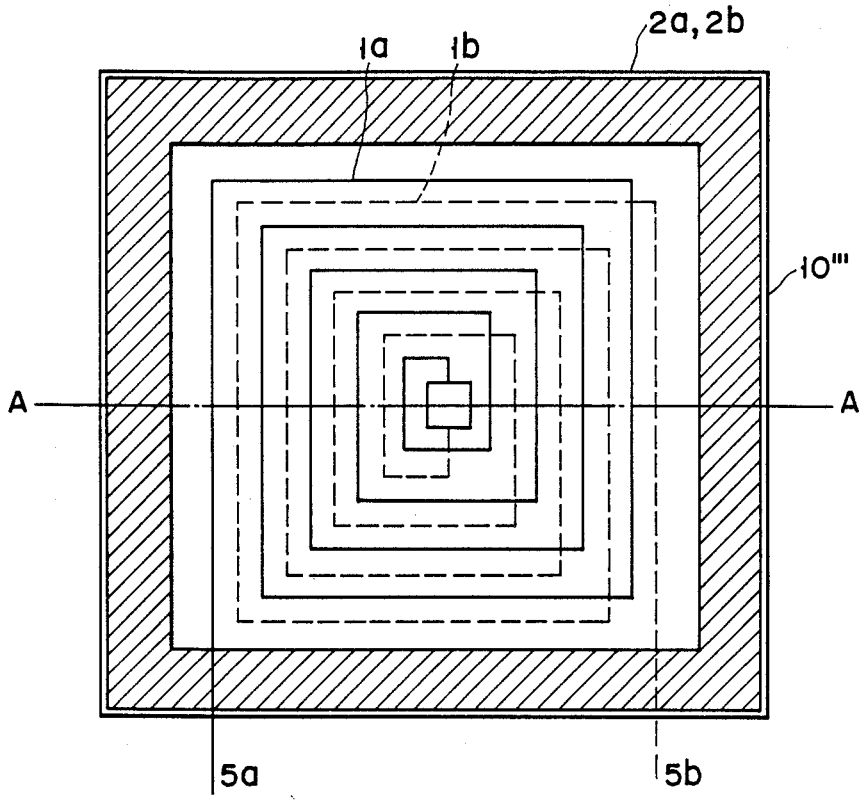
Figure 12B:
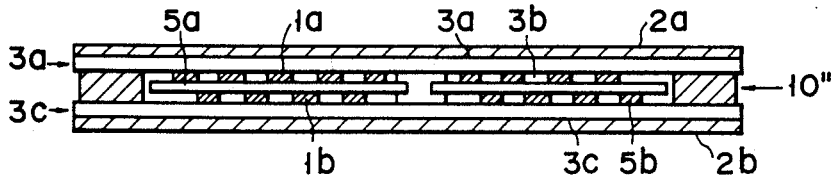

A planar inductor according to Embodiment 4 was manufactured, as shown in FIG. 12. This inductor has the same construction as that of Comparative Example 5, except that ferromagnetic substance 10" is disposed flush with spiral conductor coils 1*a* and 1*b* so as to surround the outer periphery of the coil assembly.

Figure 13:
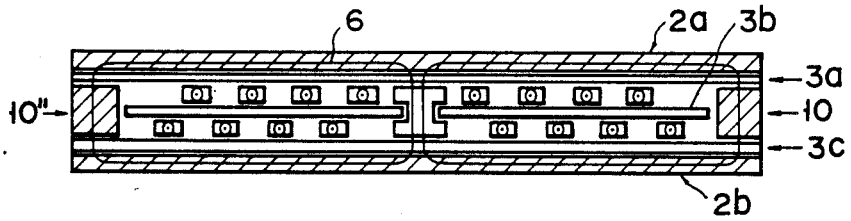
FIG. 13 is a diagram for illustrating flux paths of the planar inductor according to the fourth embodiment shown in FIG. 12.

The path of magnetic flux 6 of the planar inductor (Embodiment 4) constructed in this manner is indicated by an arrowhead line in FIG. 13. The frequency characteristic of this planar inductor was actually examined. Characteristic curve I" of FIG. 14 represents the result of the examination.

For comparison, a planar inductor, composed of the same spiral conductor coils, insulating layers, and ferromagnetic ribbons as are used in Embodiment 4, was formed having a gap portion without a ferromagnetic substance surrounding the outer periphery of the coil assembly (Comparative Example 6). The frequency characteristic of this comparative example was also examined. Curve II" of FIG. 14 represents the examination result.

Figure 14:
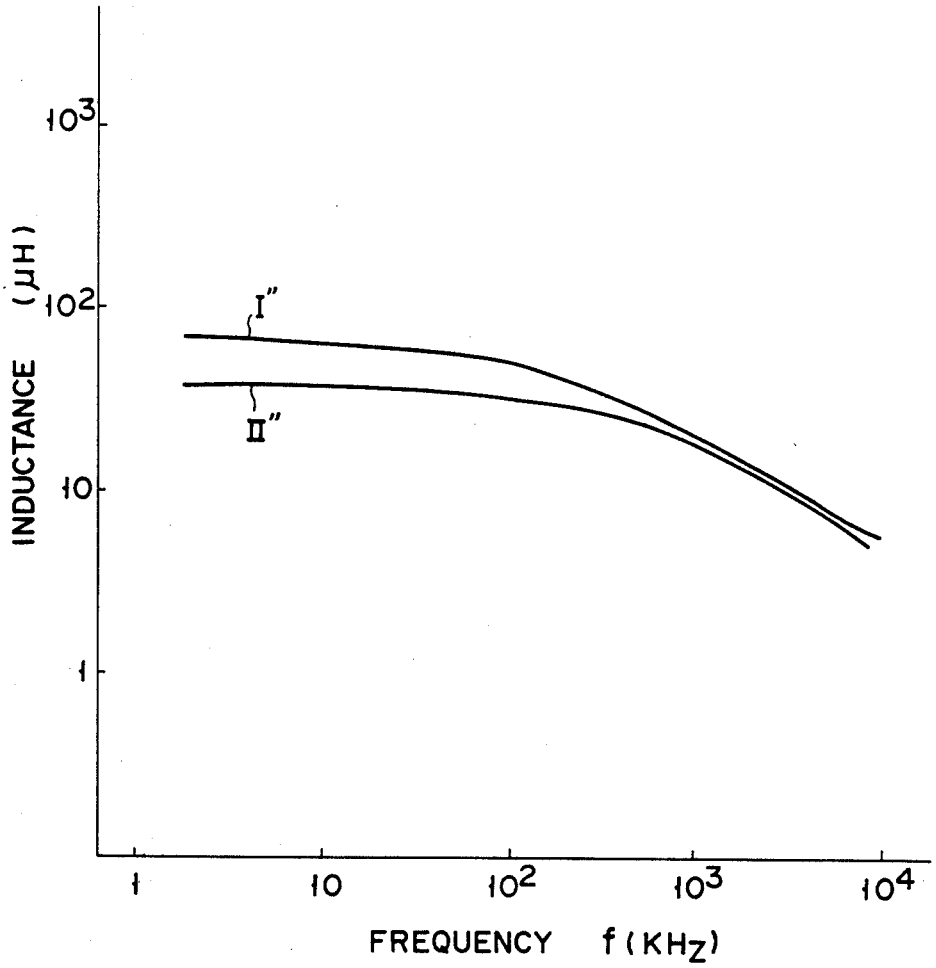

As seen from the results shown in FIG. 14, the planar inductor of Embodiment 4, as compared with Comparative Example 6, was found to have a greater inductance value throughout the frequency band and, therefore, an improved inductance value per unit volume.

Embodiment 5

Figure 15A:
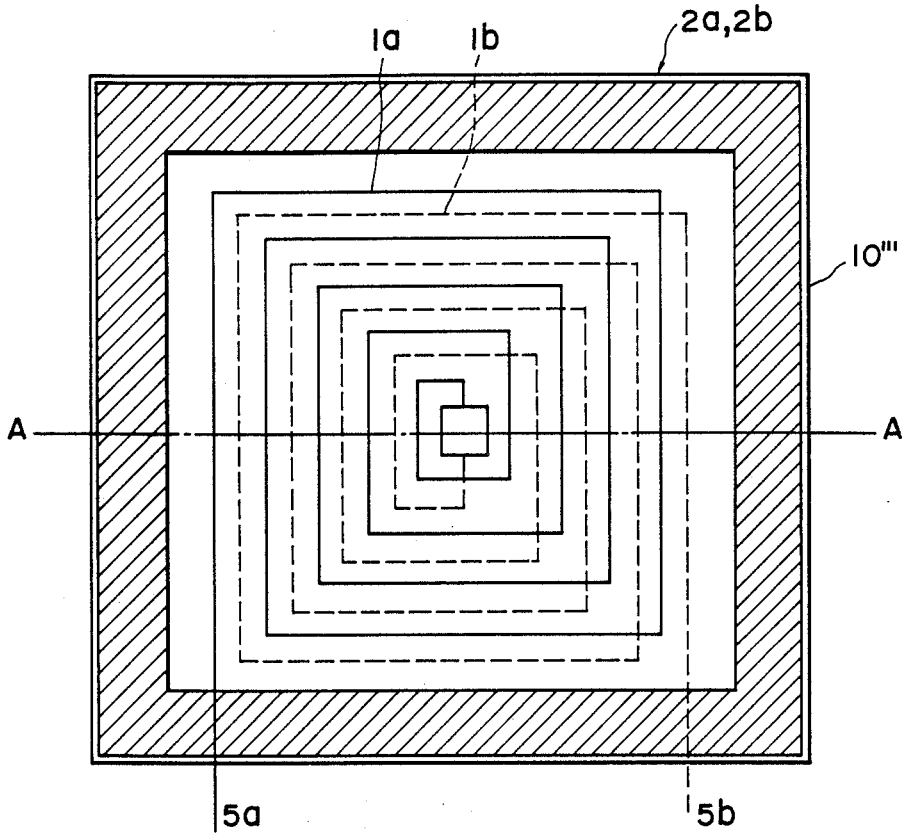
Figure 15B:
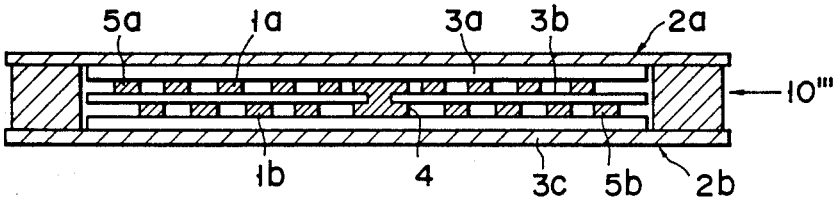

A planar inductor according to Embodiment 5 was manufactured, as shown in FIG. 15. In this inductor, ferromagnetic substance 10''' covers those regions where insulating layers 3*a* and 3*c*, just inside ferromagnetic ribbons 2*a* and 2*b*, respectively, are removed. The planar inductor of this embodiment, as compared with Embodiment 4, was found to have a further greater inductance value throughout the frequency band and, therefore, an improved inductance value per unit volume.

Embodiment 6

Figure 16A:
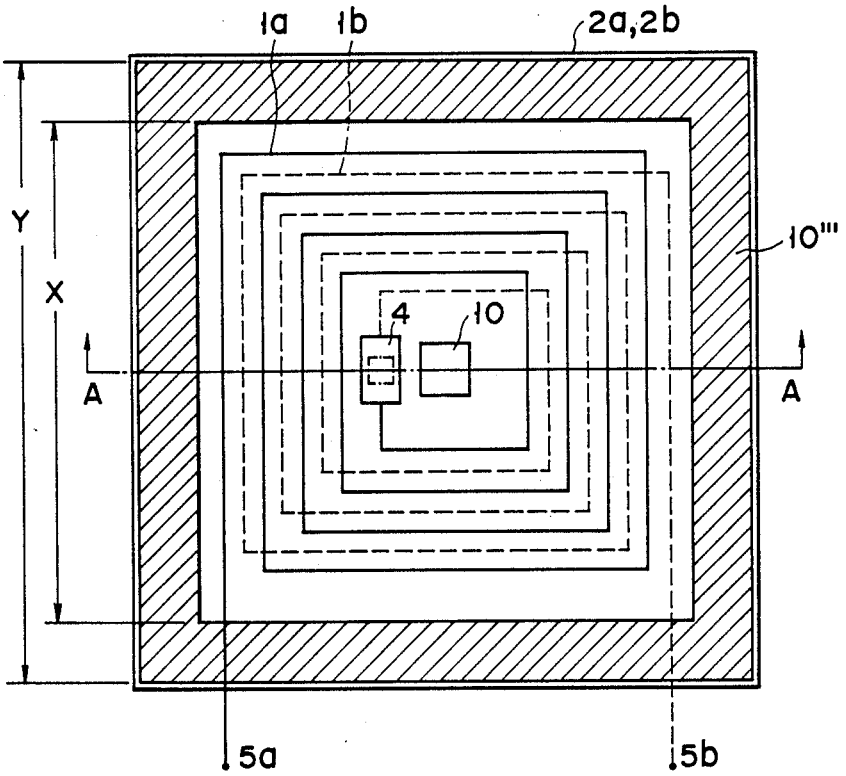
FIG. 16A is a plane view of a planar inductor according to a sixth embodiment of the present invention.
Figure 16B:
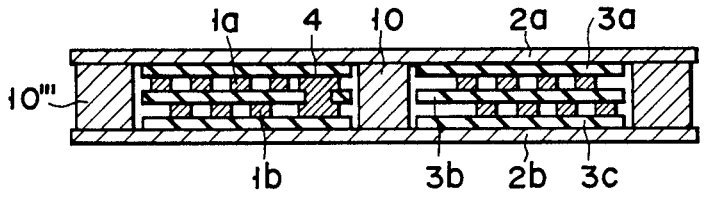
FIG. 16B is a sectional view of the planar inductor of the sixth embodiment as taken along line A—A of FIG. 16A.

The influence of the thickness of the ferromagnetic ribbons was examined on the planar inductor with the configuration shown in FIG. 16. In this planar inductor, ferromagnetic substance 10 is disposed in the center of an assembly of spiral conductor coils 1*a* and 1*b*, while ferromagnetic substance 10''' is disposed in the region surrounding the outer periphery of the coil assembly. In this case, conductor coils 1*a* and 1*b*, which are formed by etching a thick copper foil of 35 μm thickness, have a width of 0.25 mm, coil pitch of 0.25 mm, 40 turns, and external size of 20 mm by 20 mm.

These coils are arranged in two layers so that insulating layer 3*b*, formed of a polyimide film of 25 μm thickness, is interposed between the layers, and are connected to one another through a through hole in the center. A polyimide film of 12 μm thickness is used for insulating layers 3*a* and 3*c*.

Ferromagnetic ribbons 2*a* and 2*b*, which have an external size of 25 mm by 25 mm each, are obtained by cutting down five Co-based amorphous alloy ribbons with different average thicknesses, ranging from 5 to 25 μm, the alloy ribbons being formed by simple rolling and having a composition as follows:

$$(Co_{0.88}Fe_{0.06}Ni_{0.04}Nb_{0.02})_{75}Si_{10}B_{15}.$$

The effective permeability of this Co-based amorphous alloy is $2\times10^4$ (1 kHz) or $1\times10^4$ (100 kHz).

Ferromagnetic substance 10, which is disposed in the center of the coil assembly, is formed of six ribbons in layers which, having an external size of 2 mm by 2 mm, are obtained by cutting down a Co-based amorphous alloy having the aforesaid composition and an average thickness of 20 μm. Ferromagnetic substance 10''', which is disposed outside the outer periphery of spiral conductor coils 1*a* and 1*b*, is formed of six frame-shaped ribbons in layers which, having an internal size (indicated by X in FIG. 16A) of 21 mm and an external size (indicated by Y) of 25 mm, are obtained by cutting down a Co-based amorphous alloy having the aforesaid composition and an average thickness of 20 μm.

For comparison, five planar inductors (Comparative Example 7) were prepared. These inductors, whose ferromagnetic ribbons 2a and 2b are different in average thickness, have the same construction as aforesaid, except that neither of ferromagnetic substances is disposed in the center of or outside the outer periphery of the coil assembly.

Figure 17:
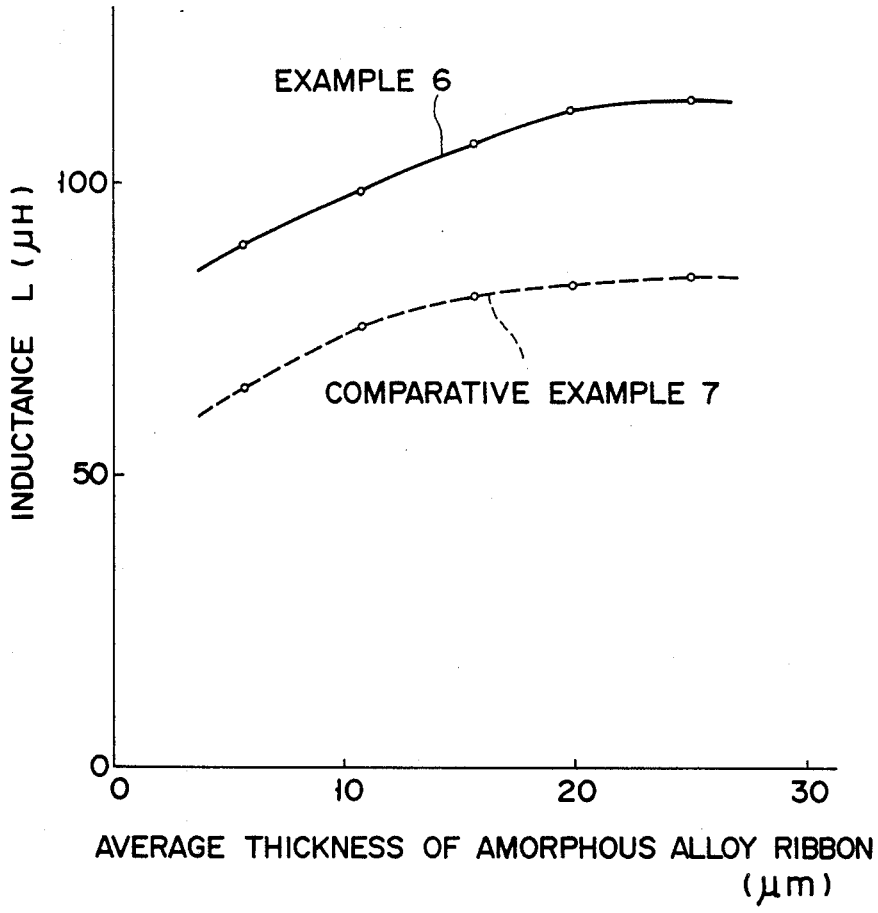
FIG. 17 shows characteristic curves indicative of relationships between the respective inductances of the planar inductor of the sixth embodiment (Embodiment 6) and a planar inductor of Comparative Example 7 and the average ribbon thickness.
Figure 18:
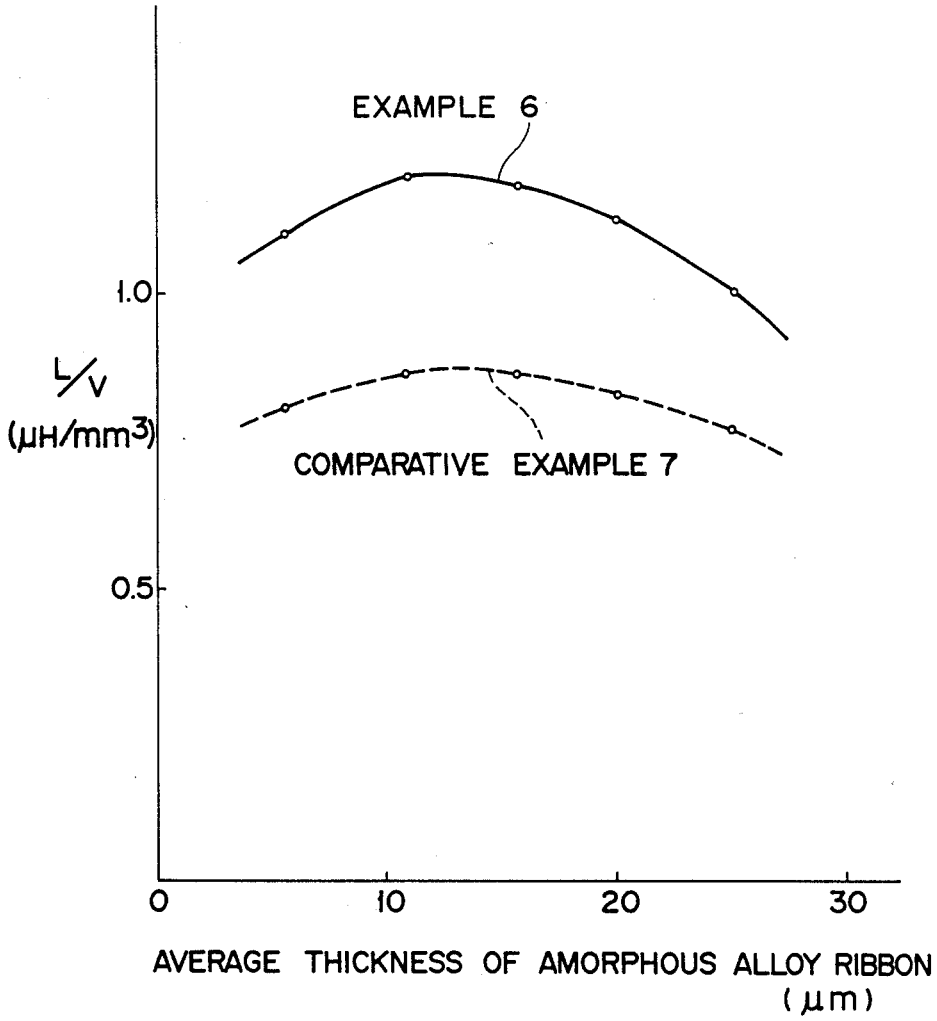
FIG. 18 shows characteristic curves indicative of relationships between the inductance per unit volume (L/V) of the planar inductors of Embodiment 6 and Comparative Example 7 and the average ribbon thickness.

FIG. 17 shows the dependence of the inductance (L) on the thickness of ferromagnetic ribbons 2a and 2b, and FIG. 18 shows the dependence of the inductance value per unit volume (L/V) on the ribbon thickness, with respect to the planar inductors of the different configurations prepared in the aforesaid manner. In FIGS. 17 and 18, full- and broken-line curves represent results for the planar inductors of Embodiment 6 and Comparative Example 7, respectively.

As seen from FIGS. 17 and 18, inductance L tends to increase as the average thickness of ferromagnetic ribbons 2a and 2b increases, while value L/V has a maximum when the average ribbon thickness ranges from about 10 to 15 μm, without regard to the presence of ferromagnetic substances 10 and 10'''. When ferromagnetic substances 10 and 10''' are disposed in the center of and outside the outer periphery of the coil assembly, both L and L/V are much greater than when the ferromagnetic substances are not used at all. Thus, the ribbon thickness should range from 4 to 20 μm, preferably from 10 to 15 μm.

It was ascertained that the same results as are shown in FIGS. 17 and 18 can be obtained from the planar inductor of Embodiment 3 (FIG. 10) in which the two spiral conductor coils are arranged flush with each other and electrically connected so that currents of opposite directions flow through the coils.

Embodiment 7

Figure 19:
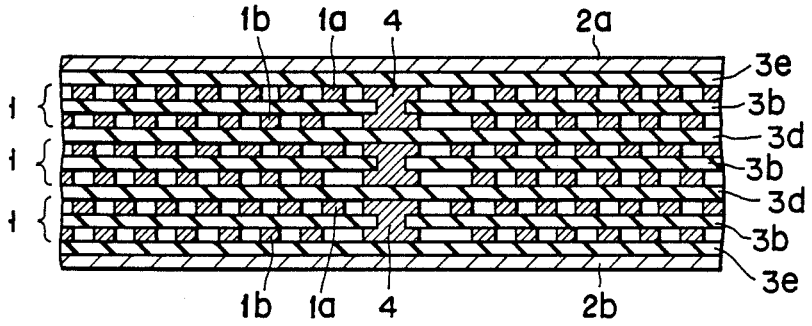
FIG. 19 is a sectional view of a planar inductor according to a seventh embodiment of the present invention.
Figure 20:
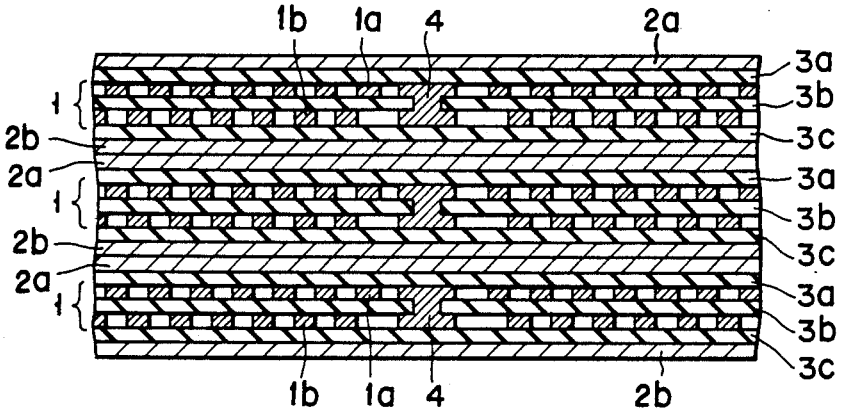
FIG. 20 is a sectional view of a planar inductor prepared as a comparative example for the seventh embodiment.

FIG. 19 is a sectional view of a planar inductor according to Embodiment 7 of the present invention, and FIG. 20 is a sectional view of a planar inductor prepared as a comparative example for comparison therewith. In either case, the plane view of the inductor resembles FIG. 1A and, therefore, is omitted. In FIGS. 19 and 20, each spiral conductor coil assembly 1 is formed of spiral coils 1a and 1b with an external size of 20 mm by 20 mm, width of 250 μm, coil pitch of 500 μm, and 40 turns (20 turns on each side). Coils 1a and 1b are obtained by forming a both-sided FPC board, which includes a polyimide film (insulating layer 3b) of 25 μm thickness and Cu foils of 35 μm thickness formed on either side thereof and connected to each other through center through hole 4, and then etching the Cu foils.

In manufacturing the planar inductor of Embodiment 7, as shown in FIG. 19, three conductor coil assemblies 1 with the aforementioned configuration were stacked in layers with polyimide films (insulating layers 3d) of 7 μm thickness between them. The resulting laminated structure was sandwiched between two square ribbons (ferromagnetic layers 2a and 2b) with polyimide films (insulating layers 3e and 3f) of 7 μm between the laminated structure and their corresponding ribbons. Each square ribbon, whose side is 25 mm long, was cut out from a Co-based high-permeability amorphous alloy ribbon which, having a thickness of 18 μm and a width of 25 mm, was formed by simple rolling. An instantaneous bonding agent was applied to the side faces of the resulting planar inductor with the laminate construction, in order to bond the individual layers together.

For comparison, three planar inductors (Comparative Example 8) were stacked in layers, as shown in FIG. 20. Each of these inductors includes spiral conductor coil assembly 1, which is sandwiched between two 25-mm square ribbons (ferromagnetic layers 2a and 2b) 18 μm thick, with polyimide films (insulating layers 3a and 3c) of 7 μm between the coil assembly and their corresponding ribbons. Coil assembly 1 is composed of spiral coils 1a and 1b, with an external size of 20 mm by 20 mm, width of 250 μm, coil pitch of 500 μm, and 40 turns (20 turns on each side), and a polyimide film (insulating layer 3b) of 25 μm thickness sandwiched between the coils. An instantaneous bonding agent was applied to the side faces of the resulting planar inductor with the laminate construction.

In either of the planar inductors of Embodiment 7 and Comparative Example 8, three spiral conductor coil assemblies 1 are connected to one another so that currents of the same phase flow through them.

The thicknesses of the planar inductors of Embodiment 7 and Comparative Example 8 are 510 μm and 605 μm, respectively.

Figure 21:
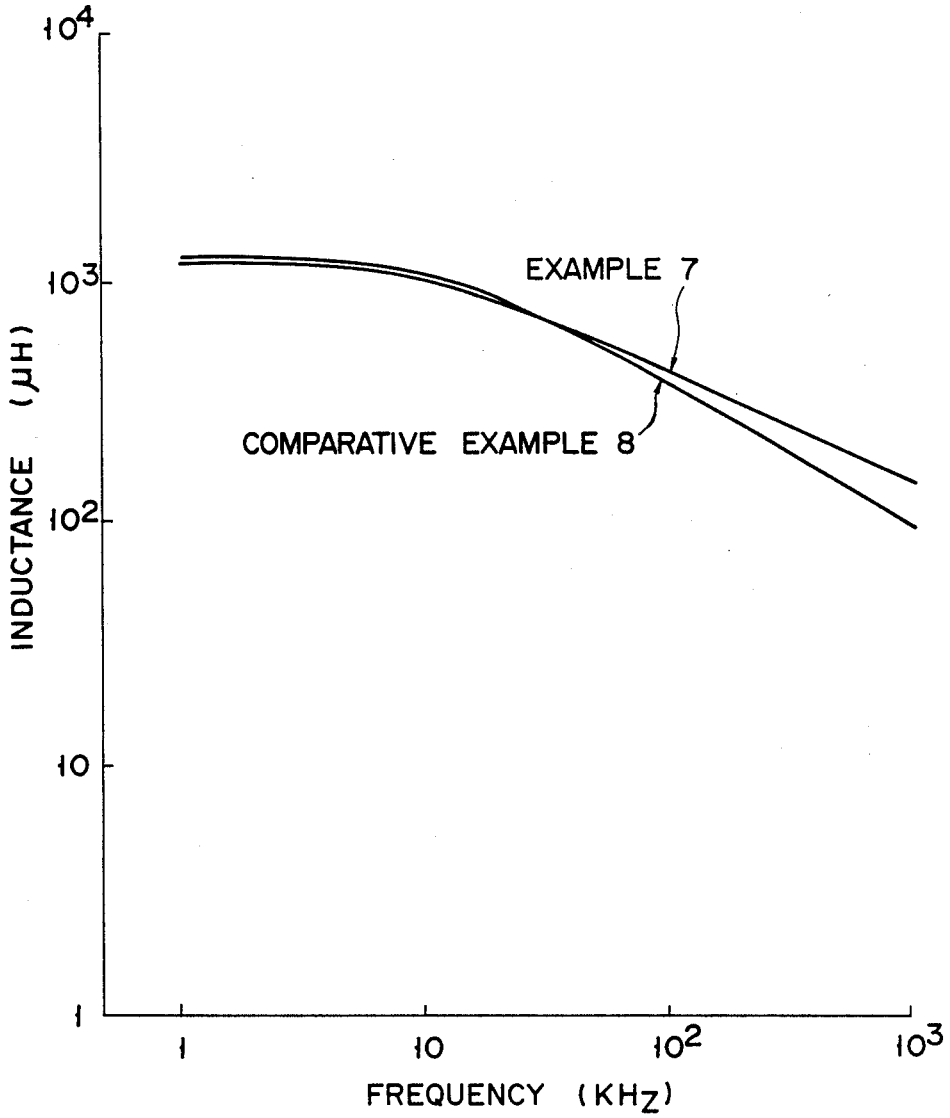
FIG. 21 shows characteristic curves indicative of the frequency characteristics of inductances L of the planar inductors of the seventh embodiment and the comparative example.
Figure 22:
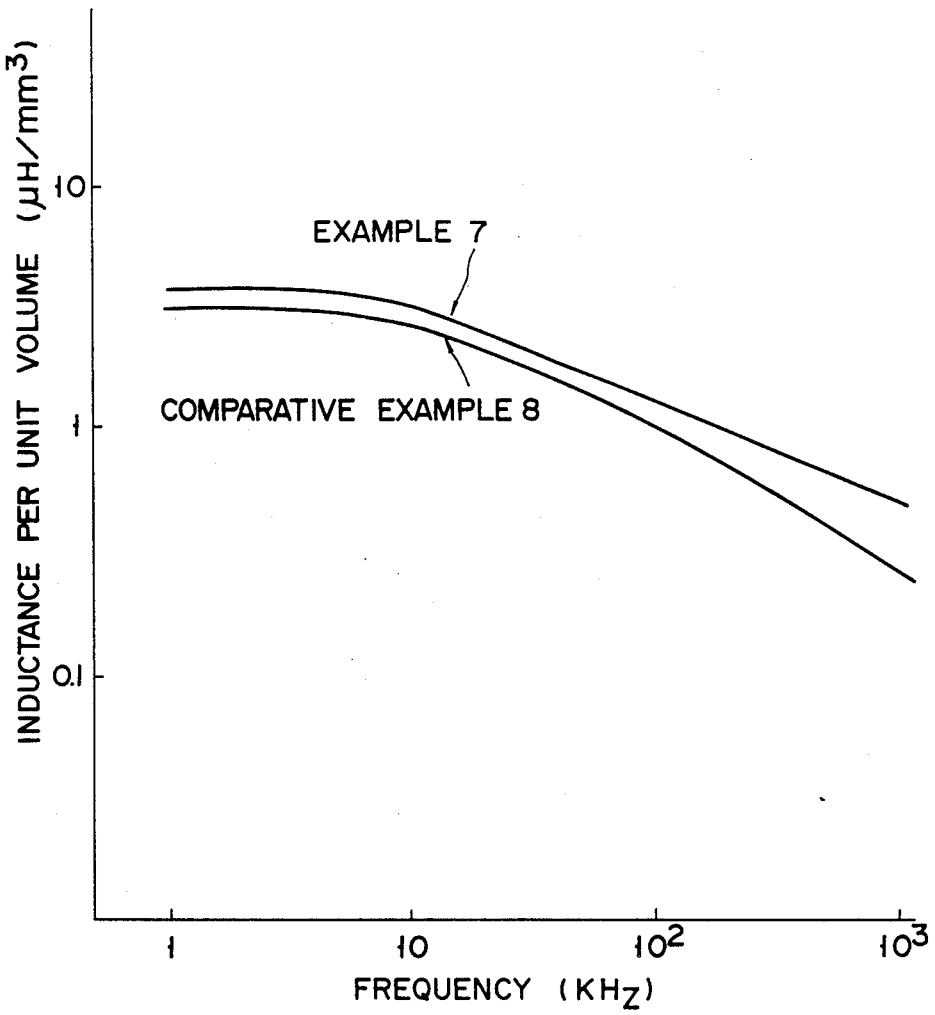
FIG. 22 shows characteristic curves indicative of the frequency characteristics of the respective inductors per unit volume (L/V) of the planar inductors of the seventh embodiment and the comparative example.

FIG. 21 shows the frequency characteristic of inductance L of each planar inductor, and FIG. 22 shows that of inductance L/V per unit volume.

As seen from FIG. 21, the values of inductance L of the planar inductors of Embodiment 7 and Comparative Example 8 are substantially equal. On the high-frequency side, however, the inductor of Embodiment 7, which is thinner, is rather greater in inductance.

As seen from FIG. 22, moreover, the value of inductance L/V per unit volume of the planar inductor of Embodiment 7 is about 20% greater than that of the planar inductor of Comparative Example 7.

Figure 23:
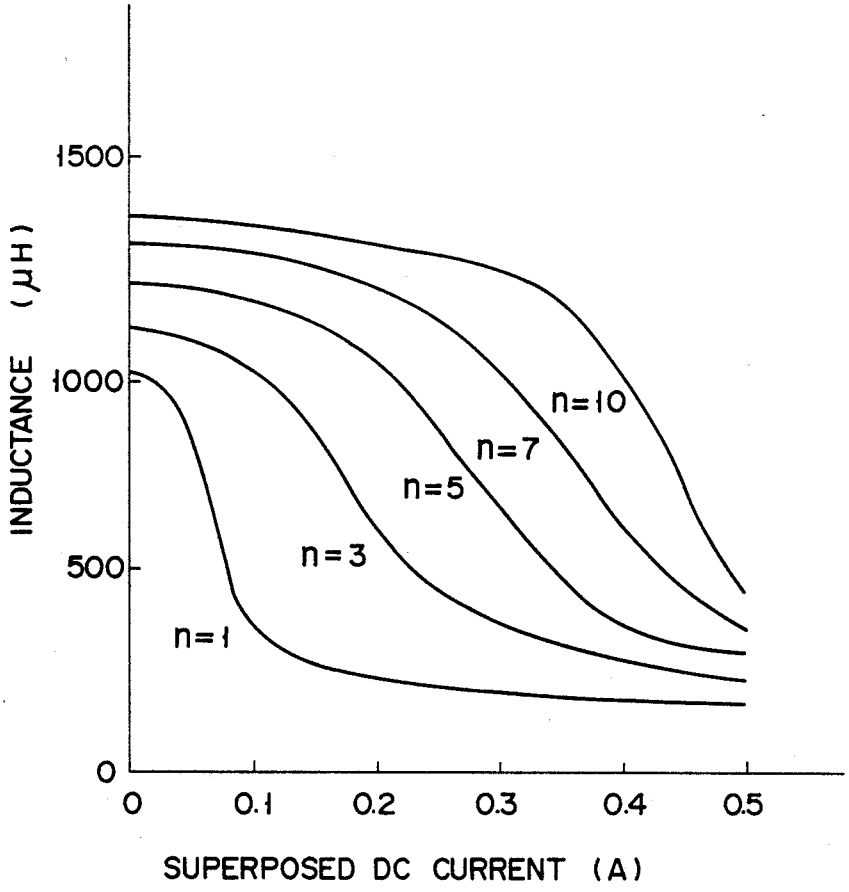
FIG. 23 shows characteristic curves indicative of relationships between the superposed DC current and the inductance of the planar inductor of the seventh embodiment, obtained with use of the number of amorphous alloy ribbons as a parameter.
Figure 24:
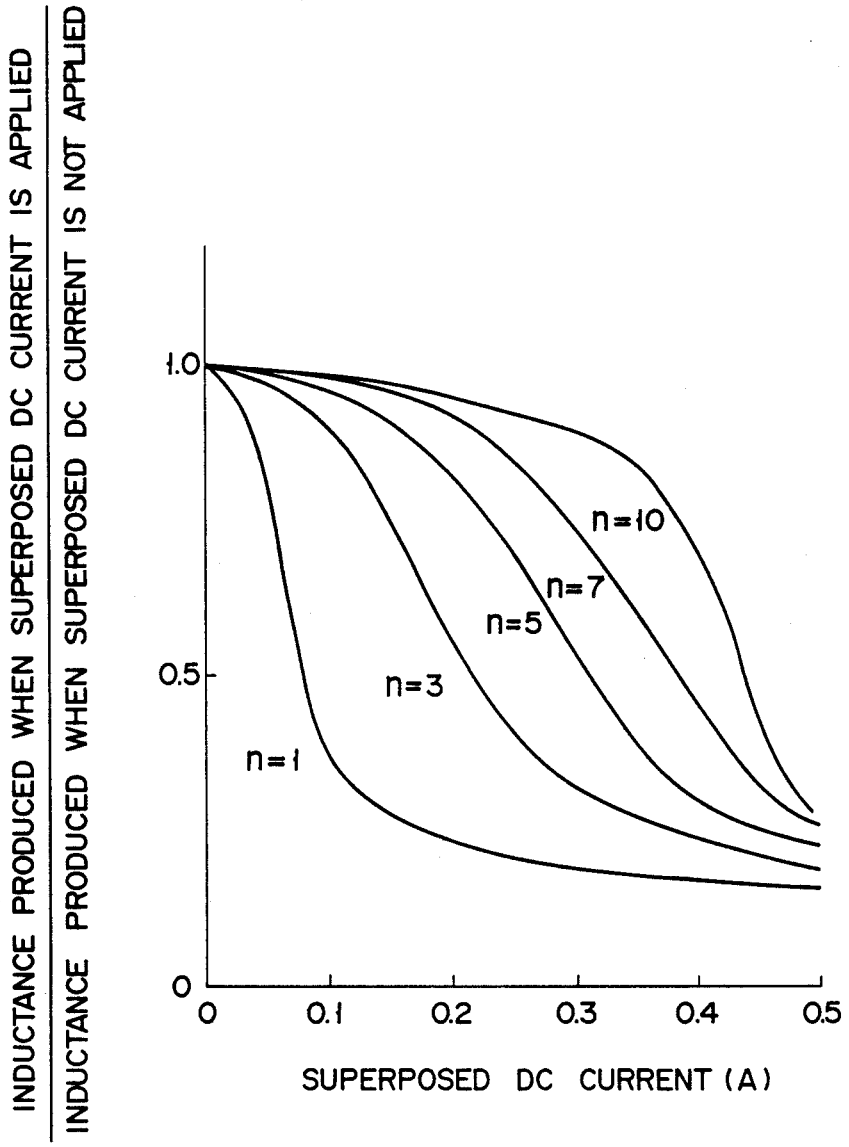
FIG. 24 shows characteristic curves indicative of relationships between the superposed DC current and the ratio of the inductance produced when the superposed DC voltage is applied to the inductance produced when the superposed DC voltage is not applied, with respect to the planar inductor of the seventh embodiment, obtained with use of the number of amorphous alloy ribbons as the parameter.
Figure 25:
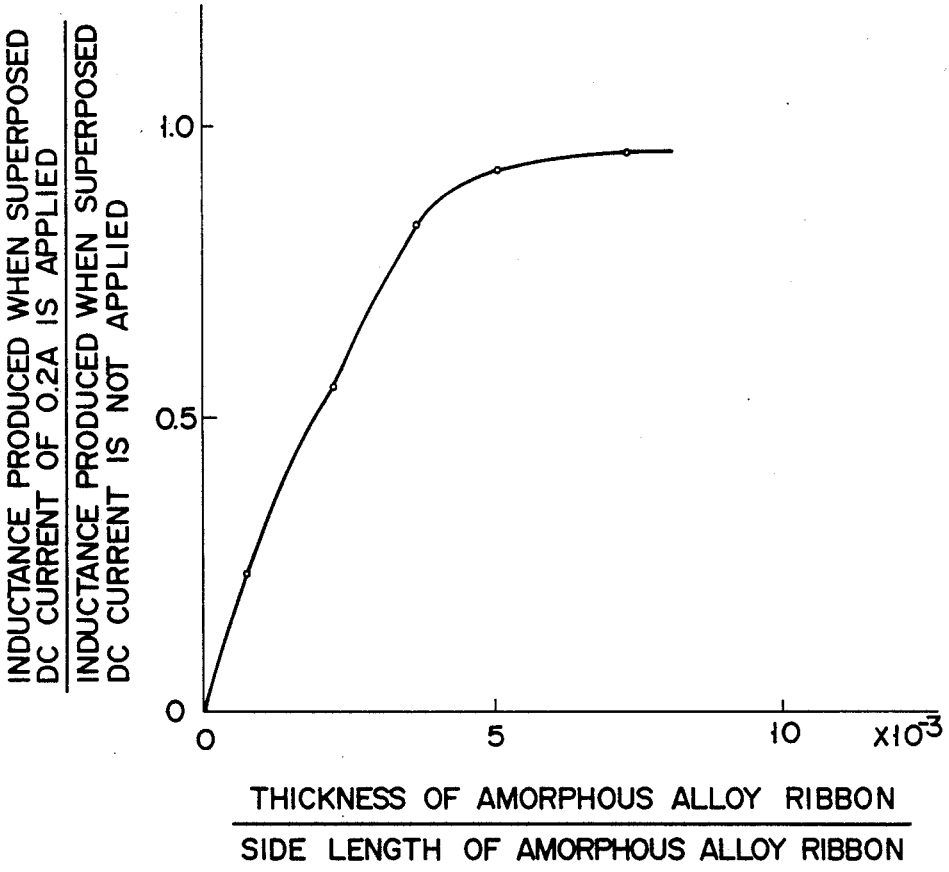
FIG. 25 shows a characteristic curve indicative of a relationship between the ratio of the thickness of the amorphous alloy ribbon to the side length thereof and the ratio of the inductance produced when a superposed DC current of 0.2 A is applied to the inductance produced when the superposed DC current is not applied, with respect to the planar inductor of the seventh embodiment.

The DC superposition characteristic was examined on planar inductors which have the same fundamental configuration as the one shown in FIG. 19, and in which one to ten square Co-based high-permeability amorphous alloy ribbons, having a thickness of 18 μm and a side 25 μm long, are used as ferromagnetic layers 2a and 2b. FIGS. 23 to 25 show results of this examination.

FIG. 23 shows characteristic curves indicative of relationships between the superposed DC current and the inductance, obtained with use of the number of amorphous alloy ribbons as a parameter. FIG. 24 shows characteristic curves indicative cf relationships between the superposed DC current and the ratio of the inductance produced when the superposed DC current is applied to the inductance produced when the superposed current is not applied, obtained with use of the number of amorphous alloy ribbons as the parameter. FIG. 25 shows a characteristic curve indicative of a relationship between the ratio of the thickness of the laminate of the amorphous alloy ribbons to the side length thereof and the ratio of the inductance produced when a superposed DC current of 0.2 A is applied to the inductance produced when the superposed DC current is not applied. All the inductance values were measured at 50 kHz.

As shown in FIG. 23, even if the number (n) of ribbons is increased, inductance $L_0$ produced when the superposed DC current is not applied can only attain a value much smaller than n times the value obtained when n equals 1. As seen from FIGS. 23 and 24, however, if number n becomes greater, then the rate of reduction of the inductance with the increase of the superposed DC current is lowered in proportion, so that the DC superposition characteristic is improved.

As seen from FIG. 25, moreover, if the ratio (t/l) of the thickness of the ribbon laminate to the side length thereof is smaller than $10^{-3}$, the ratio ($L_{0.2}/L_0$) of the inductance produced when the superposed DC current of 0.2 A is applied to the inductance produced when the superposed DC current is not applied is 0.3 or less, thus indicating a poor DC superposition characteristic. If t/l is $10^{-3}$ or more, on the other hand, $L_{0.2}/L_0$ is greater than 0.3, that is, great enough for practical use. If t/l exceeds $3.5\times10^{-3}$ moreover, $L_{0.2}/L_0$ is 0.8 or more, so that the DC superposition characteristic is considerably improved.

Embodiment 8

Figure 26A:
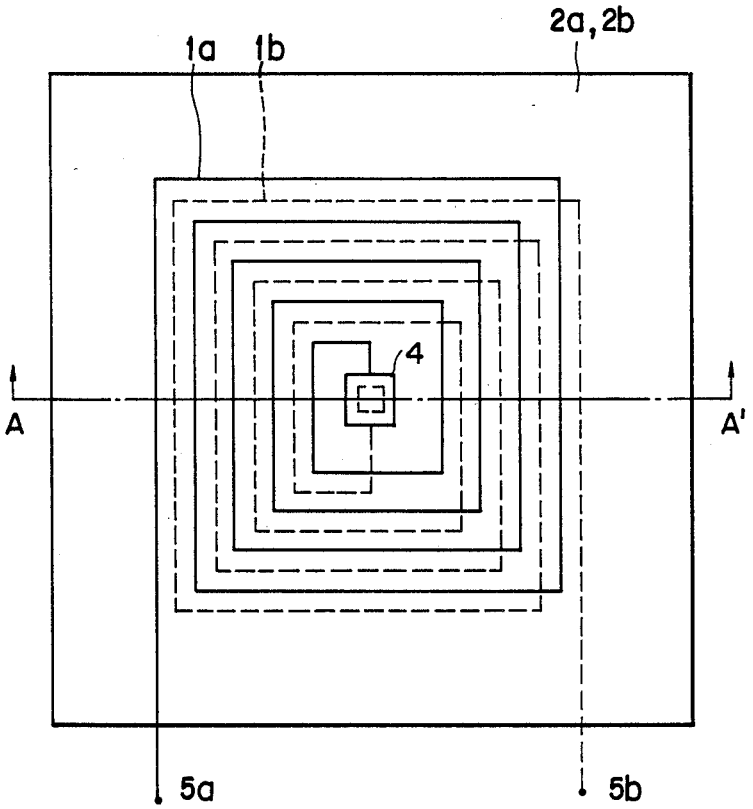
FIG. 26A is a plane view of a planar inductor according to an eighth embodiment of the present invention.
Figure 26B:
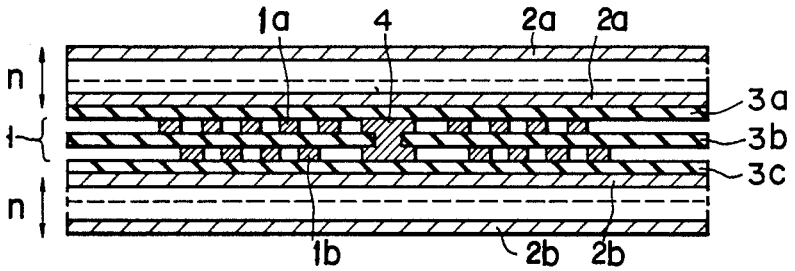
FIG. 26B is a sectional view as taken along line A—A' of FIG. 26A.

FIG. 26A is a plane view of a planar inductor according to an eighth embodiment of the present invention, and FIG. 26B is a sectional view as taken along line A—A' of FIG. 26A. In FIG. 26, spiral conductor coil assembly 1 is formed of spiral coils 1*a* and 1*b* with an external size of 20 mm by 20 mm, width of 250 μm, coil pitch of 500 μm, and 40 turns (20 turns on each side). Coils 1*a* and 1*b* are obtained by forming a both-sided FPC board (flexible printed board), which includes a polyimide film (insulating layer 3*b*) of 25 μm thickness and Cu foils of 35 μm thickness formed on either side thereof and connected to each other through center through hole 4, and then etching the Cu foils. The planar inductor of Embodiment 8 is constructed so that conductor coil assembly 1 with the aforesaid configuration is sandwiched between two sets of ferromagnetic layers each including a plurality of square ribbons (ferromagnetic ribbons 2*a* and 2*b*) with polyimide films (insulating layers 3*a* and 3*c*) of 7 μm between the coil assembly and their corresponding sets of layers. Each square ribbon, whose side is 25 mm long, is cut out from a Co-based high-permeability amorphous alloy ribbon which, having a average thickness of 16 μm and a width of 25 mm, is formed by simple rolling. An inductance is formed between terminals 5*a* and 5*b* of the planar inductor composed of these members.

For comparison, a conventional planar inductor (Comparative Example 9), which includes only one ferromagnetic ribbon on each side of the coil assembly, was prepared using the same materials as aforesaid.

Figure 27:
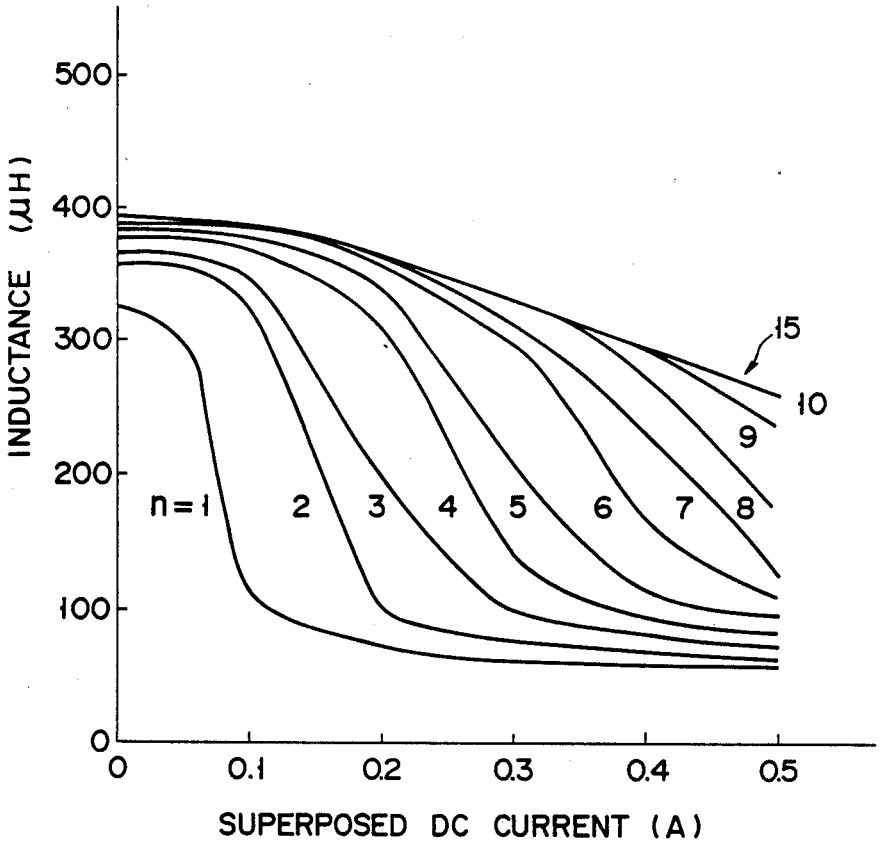
FIG. 27 shows characteristic curves indicative of relationships between the superposed DC current and the inductance of the planar inductor of the eighth embodiment, obtained with use of the number of ferromagnetic ribbons as a parameter.

FIG. 27 shows relationships between the superposed DC current and the inductance of these planar inductors, obtained with use of the number of ferromagnetic ribbons as a parameter. The inductance values were measured at 50 kHz.

As seen from FIG. 27, if number n becomes greater, then the rate of reduction of the inductance with the increase of the superposed DC current is lowered in proportion, so that the DC superposition characteristic is improved. If n is 15, however, substantially the same result is obtained as in the case where n is 10. Thus, it is indicated that the improvement effect of the DC superposition characteristic hardly makes any change if the ferromagnetic ribbons used exceed ten in number.

Figure 28:
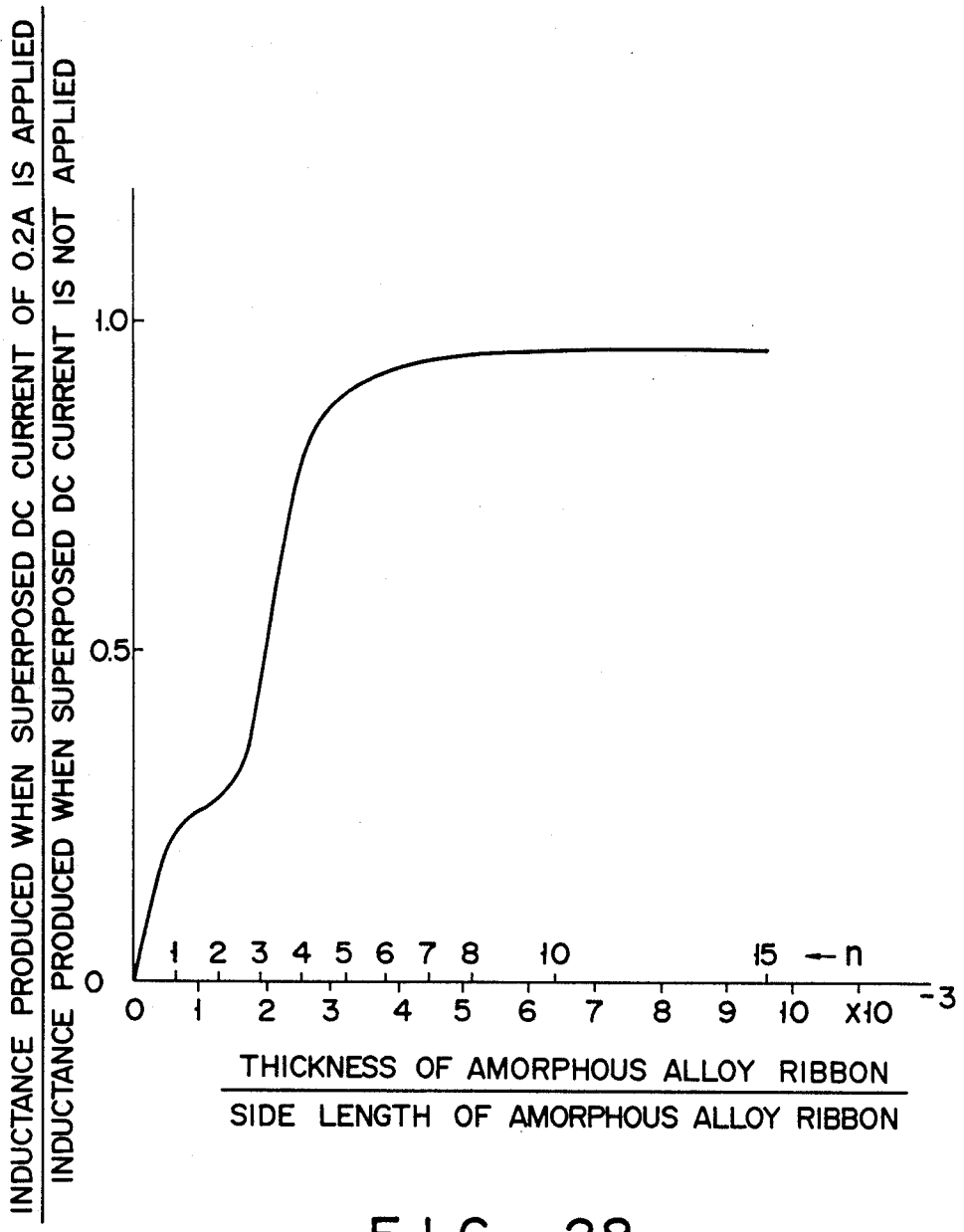
FIG. 28 shows a characteristic curve indicative of a relationship between the ratio of the thickness of the laminate of the ferromagnetic layers to the side length thereof and the ratio of the inductance produced when a superposed DC current of 0.2 A is applied to the inductance produced when the superposed DC current is not applied, with respect to the planar inductor of the eighth embodiment.

FIG. 28 shows a relationship between the ratio of the thickness of the laminate of the ferromagnetic layer to the side length thereof and the ratio of the inductance ($L_{0.2}$) produced when a superposed DC current of 0.2 A is applied to the inductance ($L_0$) produced when the superposed DC current is not applied, with respect to the aforementioned planar inductors.

As seen from FIG. 28, if ratio t/l is smaller than $10^{-3}$, ratio $L_{0.2}/L_0$ is smaller than 0.5, thus indicating a poor DC superposition characteristic. If t/l is $3\times10^{-3}$ or more, on the other hand, $L_{0.2}/L_0$ is 0.85 or more, so that the DC superposition characteristic is considerably improved.

Furthermore, a planar inductor according to the present was applied to a DC-DC converter of a 5 V/2 W type, and its efficiency was examined with use of 15 V input voltage and 0.2 A output current. Thereupon, efficiency $\eta$ was found to be about 60% when n is 1, while it increased to 71% when n was increased to 5.

What is claimed is:

1. A planar inductor comprising a laminated structure including a plurality of spiral conductor coil means sandwiched between ferromagnetic layers each including a plurality of ferromagnetic ribbons, each said ferromagnetic ribbon having a thickness of 100 μm or less.

2. A planar inductor according to claim 1, comprising:

insulating layers interposed between said plural spiral conductor coil means and said ferromagnetic layers;

said spiral conductor coil means electrically connected in series with one another so that currents of the same direction flow through the conductor coil means; and each of said plural spiral conductor coil means stacked with insulating layers therebetween to form a stacked structure, said stacked structure disposed between said ferromagnetic layers, wherein the ferromagnetic ribbons of each layer are separated by insulating layers.

3. A planar inductor according to claim 2, wherein the thickness of each ferromagnetic ribbon falls within the range between 4 and 100 μm.

4. A planar inductor according to claim 2, wherein a ratio of the thickness of each ferromagnetic layer, composed of a plurality of ferromagnetic ribbons, to the side length falls within the range of between $2\times10^{-3}$ and $1\times10^{-2}$.

* * * * *